US011105097B2

(12) United States Patent
Kain

(10) Patent No.: US 11,105,097 B2
(45) Date of Patent: Aug. 31, 2021

(54) ROOFING PANEL FOR CONCEALING A BIOCIDAL SOURCE

(71) Applicant: Roof Rescue LLC, Montpelier, VA (US)

(72) Inventor: William W. Kain, Montpelier, VA (US)

(73) Assignee: ERASERSPACER LLC, Montpelier, VA (US)

( * ) Notice: Subject to any disclaimer, the term of this patent is extended or adjusted under 35 U.S.C. 154(b) by 0 days.

(21) Appl. No.: 16/720,737

(22) Filed: Dec. 19, 2019

(65) Prior Publication Data

US 2021/0189730 A1 Jun. 24, 2021

(51) Int. Cl.

| | |
|---|---|
| ***E04D 1/20*** | (2006.01) |
| ***E04D 1/12*** | (2006.01) |
| ***E04D 1/24*** | (2006.01) |
| ***E04D 1/30*** | (2006.01) |
| ***E04D 1/00*** | (2006.01) |

(52) U.S. Cl.
CPC ..... *E04D 1/24* (2013.01); *E04D 1/2916* (2019.08); *E04D 1/30* (2013.01)

(58) Field of Classification Search
CPC ..... E04D 13/002; E04D 1/24; E04D 1/2907; E04D 1/2916; E04D 1/08; E04D 1/20; E04D 1/23
See application file for complete search history.

(56) References Cited

U.S. PATENT DOCUMENTS

| | | | | | |
|---|---|---|---|---|---|
| 1,202,729 | A | * | 10/1916 | Nilsson | E04D 1/34 52/543 |
| 1,404,483 | A | * | 1/1922 | Scharwath | E04D 1/20 52/560 |
| 1,577,935 | A | * | 3/1926 | Runkle | E04D 1/20 52/560 |
| 1,584,023 | A | * | 5/1926 | Fischer | E04D 1/20 52/560 |
| 1,958,774 | A | * | 5/1934 | Whiting | E04D 1/20 52/560 |
| 2,051,818 | A | * | 8/1936 | Buczkowski | E04D 1/20 52/554 |
| 2,075,058 | A | * | 3/1937 | Robinson | E04D 1/24 52/560 |

(Continued)

FOREIGN PATENT DOCUMENTS

| | | | |
|---|---|---|---|
| DE | 4130365 | A1 | 3/1993 |
| DE | 19954752 | A1 | 4/2001 |

(Continued)

*Primary Examiner* — Kyle J. Walraed-Sullivan
(74) *Attorney, Agent, or Firm* — Grossman, Tucker, Perreault & Pfleger PLLC

(57) ABSTRACT

Roofing panels for concealing a biocidal source are described. In embodiments, the roofing panels include a body having as top side, a bottom side parallel with the top side, a front edge, a rear edge, and a left edge. The roofing panels may further include a first sidewall, a second sidewall, and one or more standoffs. The first and second sidewalls may have a tapered sidewall height that provides a gap between the body of the roofing panel and underlying material. The roofing panel may be installed over a biocidal source on a roof, concealing the biocidal source from view while still allowing liquid (e.g., water) to flow over the biocidal source.

19 Claims, 26 Drawing Sheets

Rear Right
Top Perspective

(56) References Cited

U.S. PATENT DOCUMENTS

| | | | | | |
|---|---|---|---|---|---|
| 2,168,217 | A * | 8/1939 | Kirschbraun | B28B 1/52 | 52/560 |
| 2,168,218 | A * | 8/1939 | Kirschbraun | E04D 1/22 | 52/560 |
| 2,462,028 | A * | 2/1949 | O'Reilly | E04D 1/20 | 52/560 |
| 2,624,298 | A * | 1/1953 | Farren | E04D 1/04 | 52/533 |
| 3,309,831 | A * | 3/1967 | Misch | E04D 1/20 | 52/546 |
| 3,479,130 | A | 11/1969 | Rapaport | | |
| 3,494,727 | A | 2/1970 | Rapaport | | |
| 3,783,570 | A * | 1/1974 | Storch | E04D 1/30 | 52/520 |
| 3,862,532 | A * | 1/1975 | Markos | E04D 1/08 | 52/521 |
| 4,276,732 | A | 7/1981 | Nielsen | | |
| 4,295,314 | A * | 10/1981 | Ferguson | E04D 1/205 | 52/553 |
| 4,554,862 | A | 11/1985 | Wolfert | | |
| 4,603,529 | A * | 8/1986 | Cronenwett | E04D 1/265 | 52/519 |
| 5,112,405 | A * | 5/1992 | Sanchez | C04B 28/02 | 106/608 |
| 5,210,989 | A * | 5/1993 | Jakel | E04D 1/16 | 106/675 |
| 5,216,864 | A | 6/1993 | Urgero | | |
| 5,630,305 | A * | 5/1997 | Hlasnicek | B29C 45/00 | 264/220 |
| 6,260,315 | B1 | 7/2001 | Smith | | |
| 7,222,465 | B2 * | 5/2007 | Watson | E04F 13/0864 | 52/592.6 |
| 7,788,870 | B1 | 9/2010 | Spencer | | |
| 8,333,639 | B2 | 12/2012 | Collister et al. | | |
| D704,353 | S * | 5/2014 | Redwine | D25/139 | |
| 9,103,124 | B2 | 8/2015 | Spencer et al. | | |
| 9,263,985 | B2 * | 2/2016 | Silberschatz | F24S 25/13 | |
| 10,000,931 | B1 | 6/2018 | Daugherty | | |
| 2002/0011043 | A1 * | 1/2002 | Freshwater | E04D 1/30 | 52/518 |
| 2005/0074581 | A1 * | 4/2005 | Albright | E04D 1/24 | 428/151 |
| 2005/0089672 | A1 * | 4/2005 | Kuipers | E04D 1/20 | 428/156 |
| 2005/0183220 | A1 | 8/2005 | Weber | | |
| 2006/0196128 | A1 * | 9/2006 | Duke | F24S 40/85 | 52/173.3 |
| 2008/0135094 | A1 * | 6/2008 | Corrales | H01L 31/052 | 136/259 |
| 2009/0173031 | A1 * | 7/2009 | Martinique | E04D 1/20 | 52/553 |
| 2010/0170169 | A1 * | 7/2010 | Railkar | H02S 20/25 | 52/173.3 |
| 2016/0229968 | A1 * | 8/2016 | Mallorey | C08J 9/0066 | |
| 2018/0209149 | A1 * | 7/2018 | Schmidt | E04D 1/20 | |

FOREIGN PATENT DOCUMENTS

| | | | |
|---|---|---|---|
| EP | 1209299 | A2 | 5/2002 |
| FR | 2634241 | A1 | 1/1990 |
| JP | 2018127874 | A | 8/2018 |

* cited by examiner

Top

Bottom

Bottom Zoom

Front

Front Top Perspective

Front Top Left
Perspective

Front Top Right
Perspective

Front Bottom Perspective

Front Bottom Perspective
Zoom

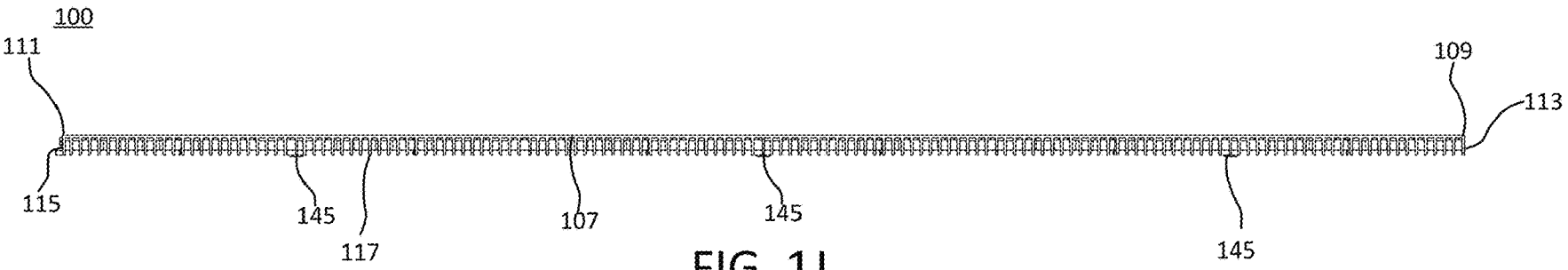
FIG. 1J
Rear Edge
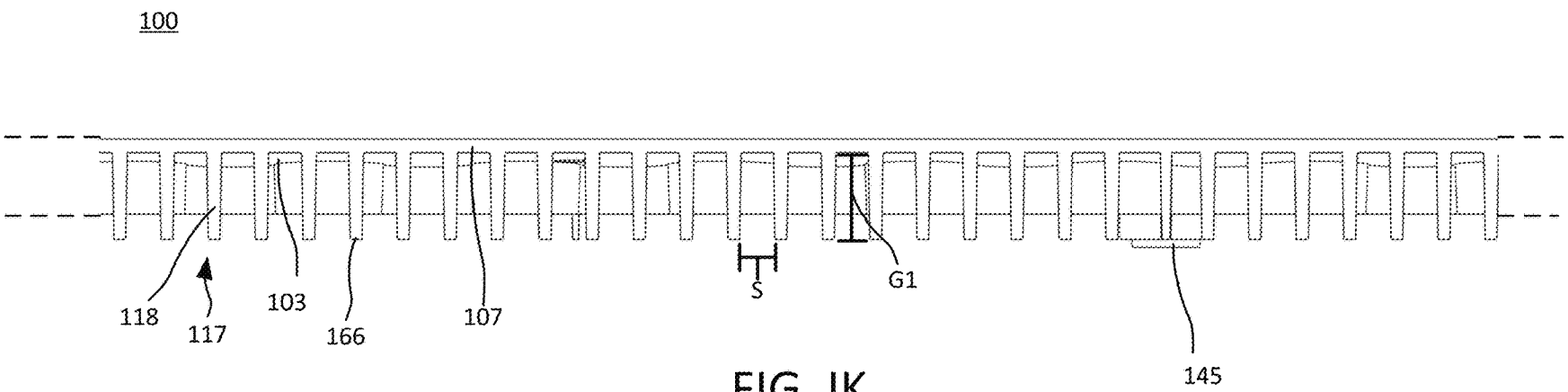
FIG. IK
Rear Edge Zoom

Rear Top Perspective

Rear Bottom Perspective

Rear Bottom Perspective
Zoom

Rear Right
Top Perspective

Rear Left Top
Perspective

Left Side

Left Side Top Zoom

Left Side Bottom Perspective

Left Side Top Front Perspective

Left Side Top Rear Perspective

Right Side

Right Side Top Zoom

Right Side Bottom Perspective

Right Side Top Front Perspective

Right Side Top Rear Perspective

ROOFING PANEL FOR CONCEALING A BIOCIDAL SOURCE

TECHNICAL FIELD

The present disclosure generally relates roofing trim panels and, in particular, to roofing trim panels for concealing a biocidal source

BACKGROUND

It is well understood in the roofing industry that biological matter can grow on roofs. For example, bacteria, fungus, plant life (e.g. moss), etc. (individually and collectively, "biological growth") can grow on shingled roofs, negatively affecting the aesthetic qualities of the roof and potentially causing damage thereto.

Roofers and other skilled artisans often place a biocidal source on a roof to mitigate or prevent biological growth thereon. Such biocidal sources are often in the form of a strip that includes or is formed of a biocidal material, such as copper, zinc, lead, or the like. The biocidal source is generally installed at or below the ridge line of a roof. Water (e.g., rain water) flowing across the biocidal source will dissolve or otherwise entrain part of the biocidal material therein, and carry the biocidal material over shingles or other roofing material that is below the biocidal source. For example when the biocidal material is or includes copper, zinc, and/or lead, water flowing over the biocidal source will entrain copper, zinc, and/or lead ions therein. The copper, zine, and/or lead ions will be conveyed by the flow over water over shingles or other roofing material below the biocidal source—scattering such ions over the roof. Those ions can act to limit or prevent unwanted biological growth on the roof downstream of the biocidal source.

Although effective, biocidal sources can be unsightly. Many biocidal sources are in the form of a metallic strip that does not blend in with the aesthetic of roofing materials such as shingles. The metals used in many biocidal sources may also oxidize over time, making them even more unsightly. Many property owners therefore do not wish to employ biocidal sources on their roof, particularly as a thick strip or multiple strips of biocidal material are often needed to adequately cover a substantial surface area of a roof.

Various systems and methods have been developed over the years to address the poor aesthetic quality of biocidal sources. For example, several ridge vent systems that incorporate a biocidal source therein have been developed. Generally, such systems utilize the structure of a ridge vent to conceal the biocidal source from view, while still allowing rain water to flow over the biocidal material. Although such solutions can effectively hide biocidal sources from view, they can be difficult and/or expensive to install in a pre-existing roof (i.e., to install on a pre-existing building). Such solutions may also use a modified ridge vent design. As ridge vents are often readily observable features of a building, property owners may notice and object to even small changes to their design, relative to a "traditional" ridge vent design.

With the foregoing in mind, the inventors have identified that there is a need in the art for a roofing trim panel that can shield a biocidal source from view, is relatively easy to install on a pre-existing roof, and which retains much or all the aesthetic quality of a roof. The technologies of the present disclosure aim to address that need.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

FIG. 1J is a rear view of a roofing panel consistent with the present disclosure;

FIG. 1K is a magnified view of a region of the rear view of FIG. 1J;

DETAILED DESCRIPTION

As used herein, the term "proximate" may be used to denote the relative position of one (first) element to another (second) element. In that context, the term "proximate" should be understood to mean that the first element is near the second element, but is not necessarily immediately adjacent the second element.

The terms "perpendicular," and "parallel" are used herein to describe the orientation of one (first) element to another (second) element. The term "perpendicular" means that a first element extends in a first direction/plane, and a second element extends at right angle to the first direction/plane. In contrast, the term "parallel" means that a first element extends in a first direction/plane, and a second element extends along a plane that is offset from the first direction/plane but which extends along the first direction or plane.

As used herein, the terms "substantially" and "about" may be used in connection with an identified value, range, or orientation. In the context of a value or a range, such terms mean+/−10% of the indicated value or range. In the context of an orientation such terms mean that one component is oriented within +/−10% of the indicated orientation. Thus, "substantially 10" or "about 10" means 9 to 11. Similarly, "substantially perpendicular" means that a second element is oriented perpendicular to a first element or within +/−10 degrees of perpendicular to the first element. Likewise, "substantially parallel" means that a second element is oriented parallel to a first element or within +/−10 degrees of parallel to the first element.

As explained in the background, various systems have been developed for concealing a biocidal source mounted to a roof. While such systems can effectively conceal a biocidal source from view (particularly from the ground), they are not without some disadvantages. For example, such systems may be difficult and/or expensive to install with a pre-existing homes, and thus are most suitable for use with new construction. Such systems may also rely on modifications to traditional ridge vent design, resulting in an installation that may also be aesthetically unappealing to some observers.

With the foregoing in mind, the present disclosure generally relates to roofing panels, and particularly to roofing panels for concealing a biocidal source. As will become apparent, the roofing panels of the present disclosure can effectively conceal biocidal sources such as metallic strips from view, while retaining much or all of the aesthetic appeal of the adjacent roofing. The roofing panels described herein are also relatively easy to install on a pre-existing home, and do not (or do not substantially affect) performance of the biocidal source.

Figure 1A:
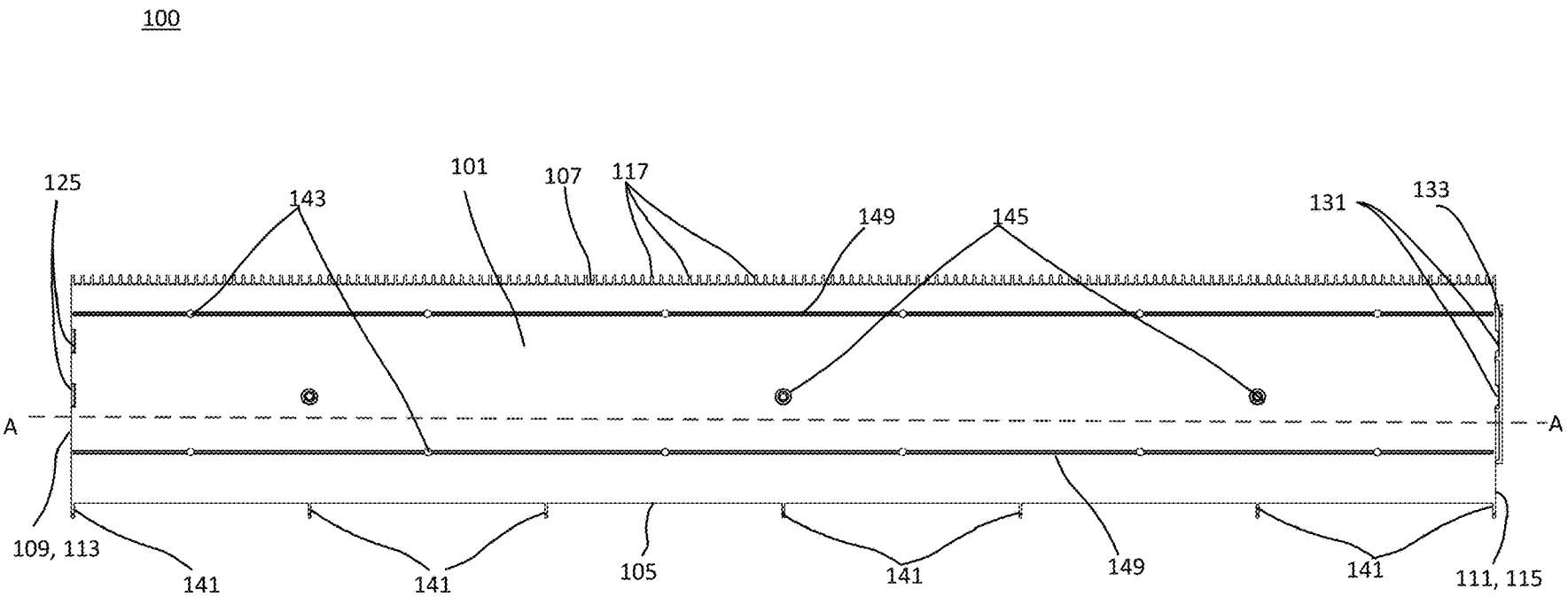
FIG. 1A is a top view of a roofing panel consistent with the present disclosure.
Figure 1B:
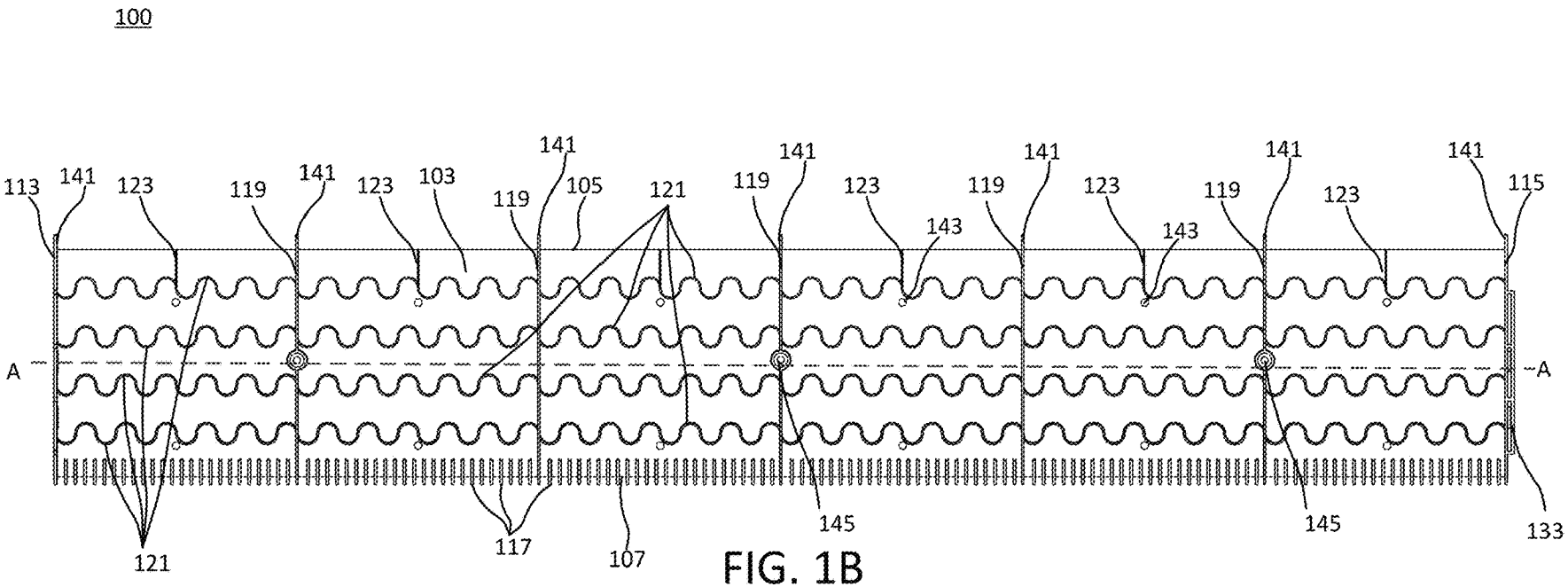
FIG. 1B is a bottom view of a roofing panel consistent with the present disclosure.
Figure 1C:
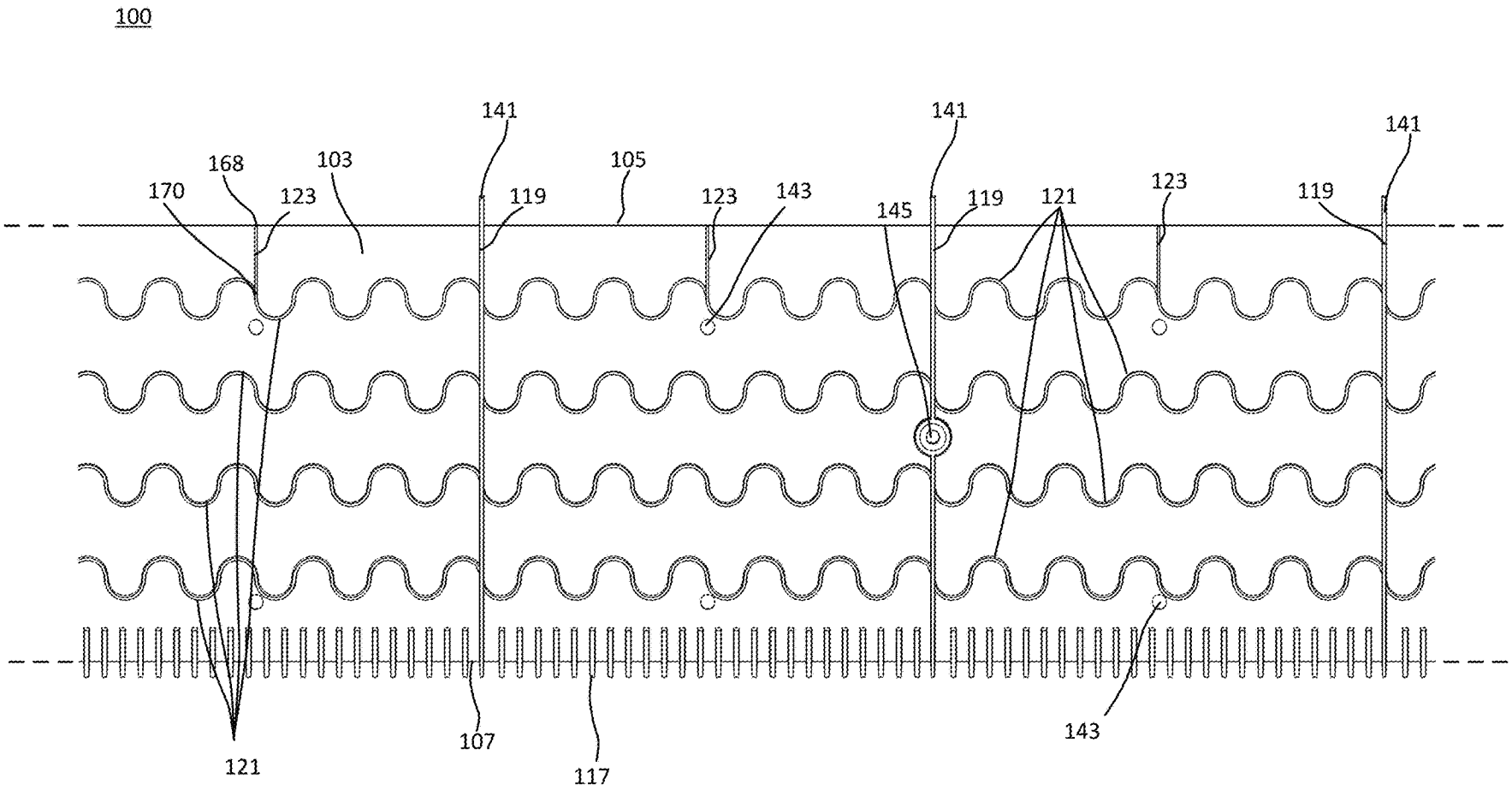
FIG. 1C is a magnified view of a region of the bottom view of FIG. 1B.
Figure 1D:
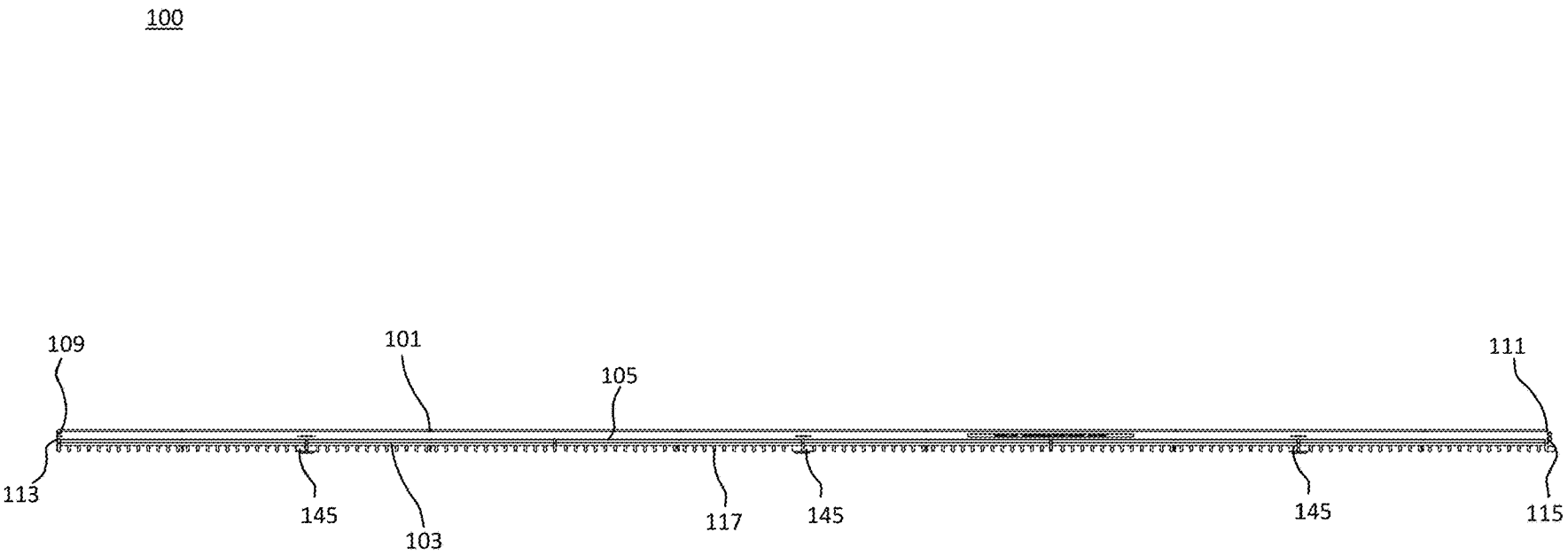
FIG. 1D is a front view of a roofing panel consistent with the present disclosure.
Figure 1E:
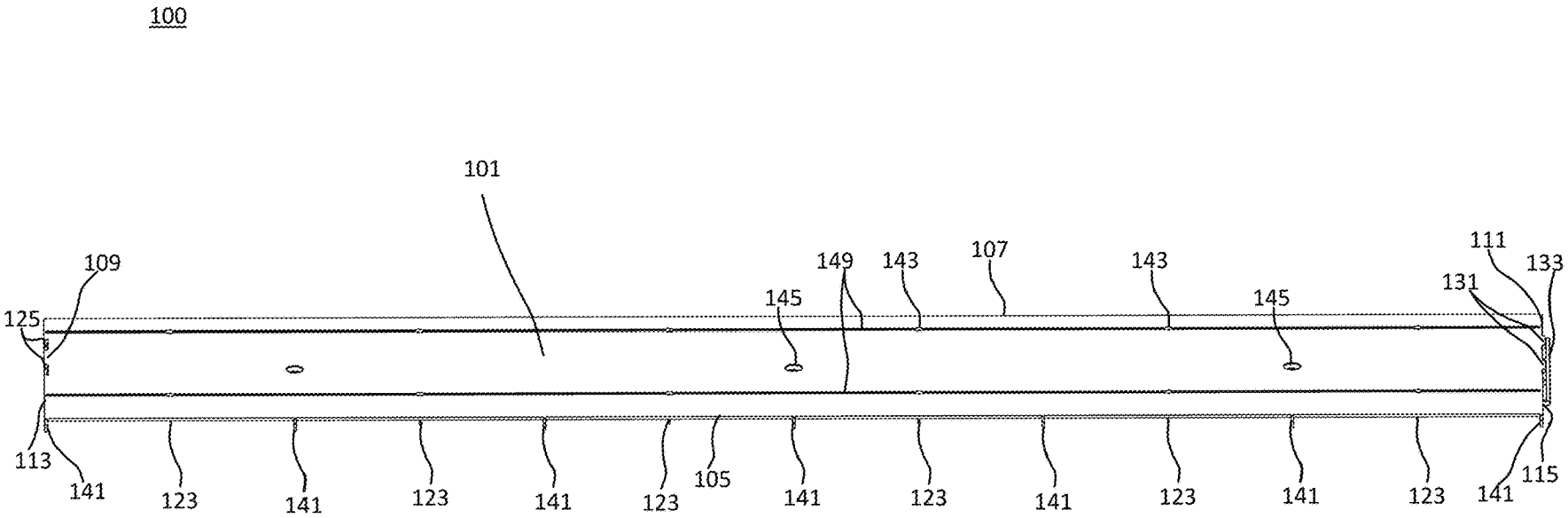
FIG. 1E is a front top perspective view of a roofing panel consistent with the present disclosure.
Figure 1F:
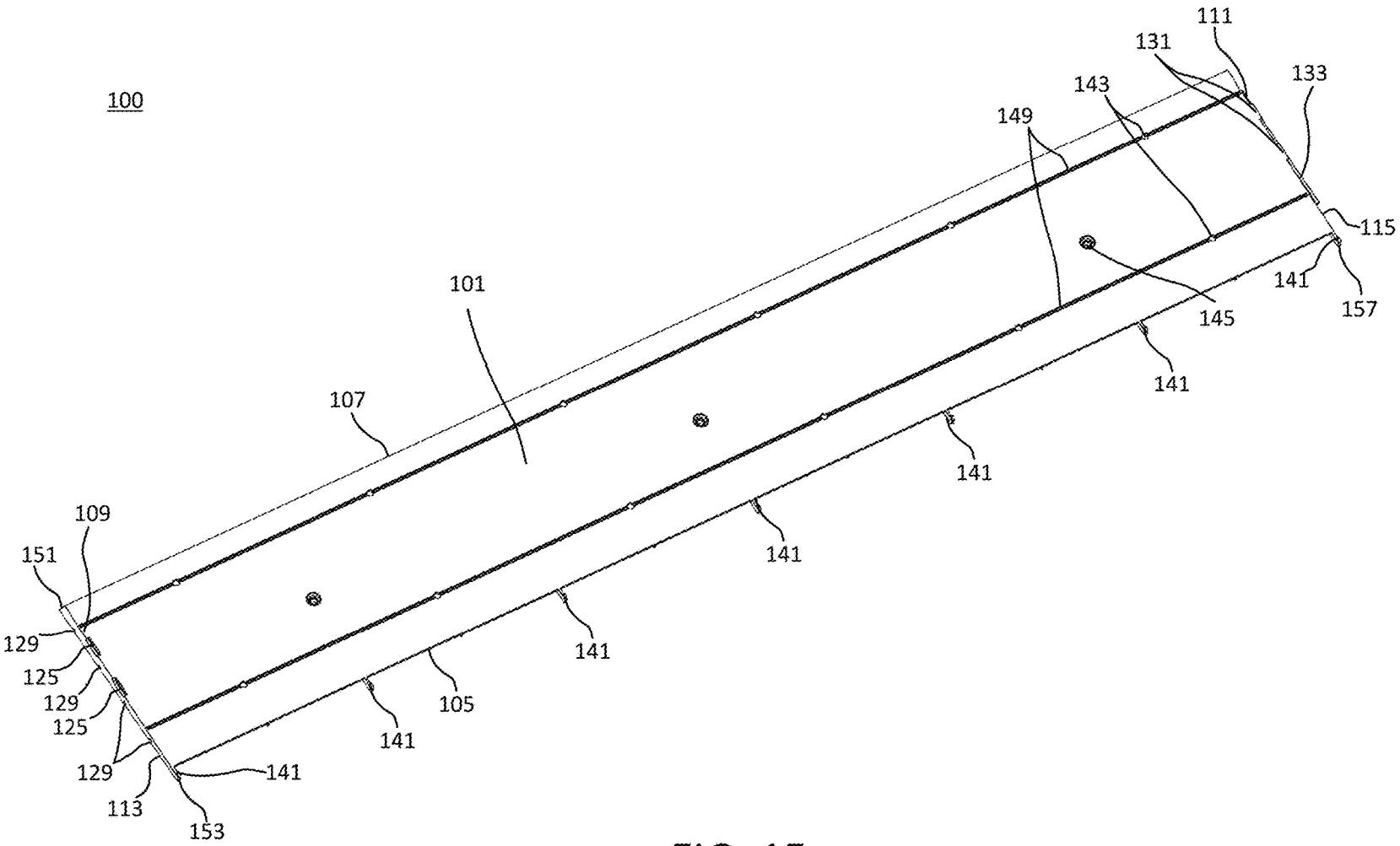
FIG. 1F is a front top left perspective view of a roofing panel consistent with the present disclosure.
Figure 1G:
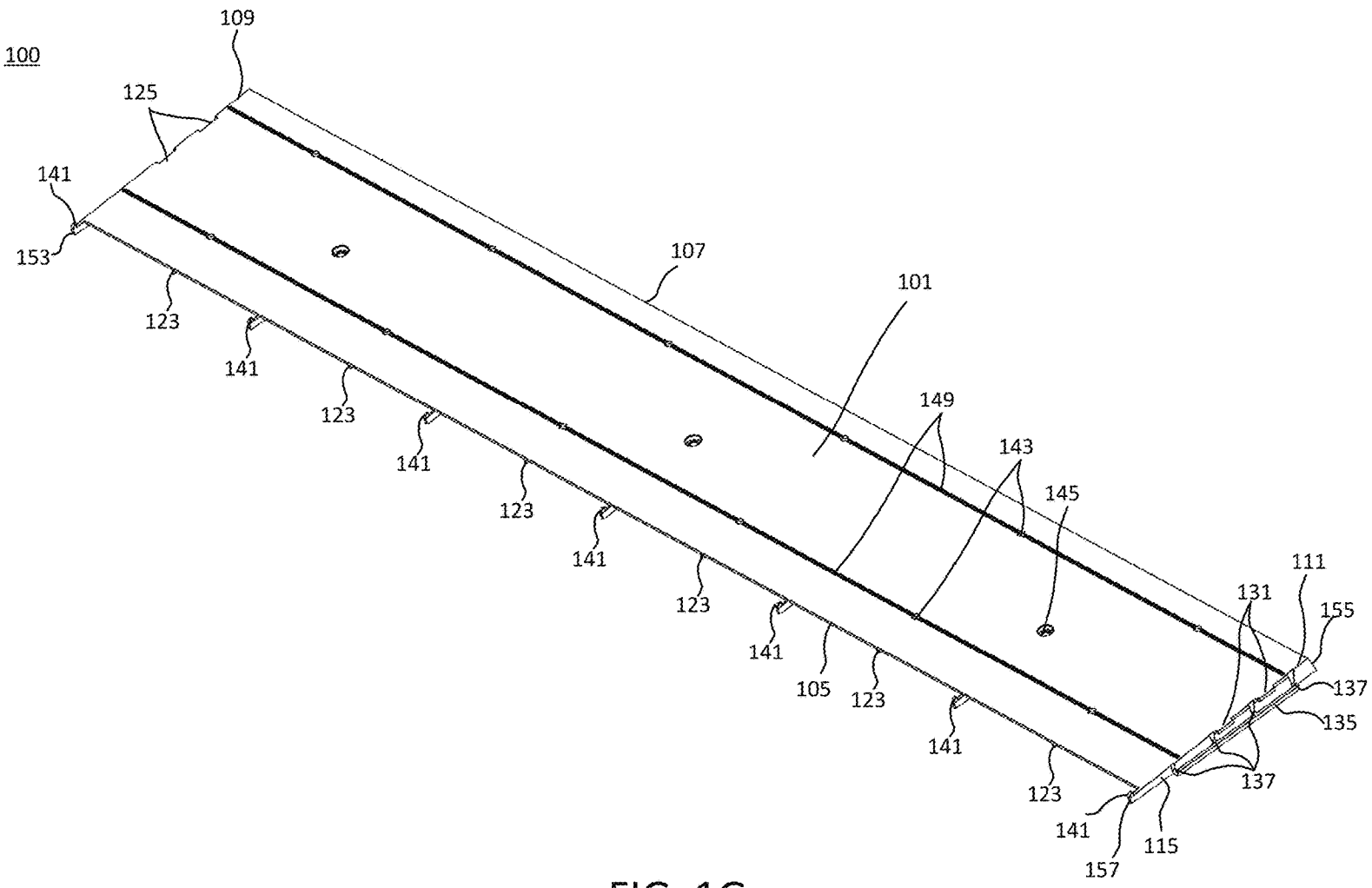
FIG. 1G is a front top right view of a roofing panel consistent with the present disclosure.
Figure 1H:
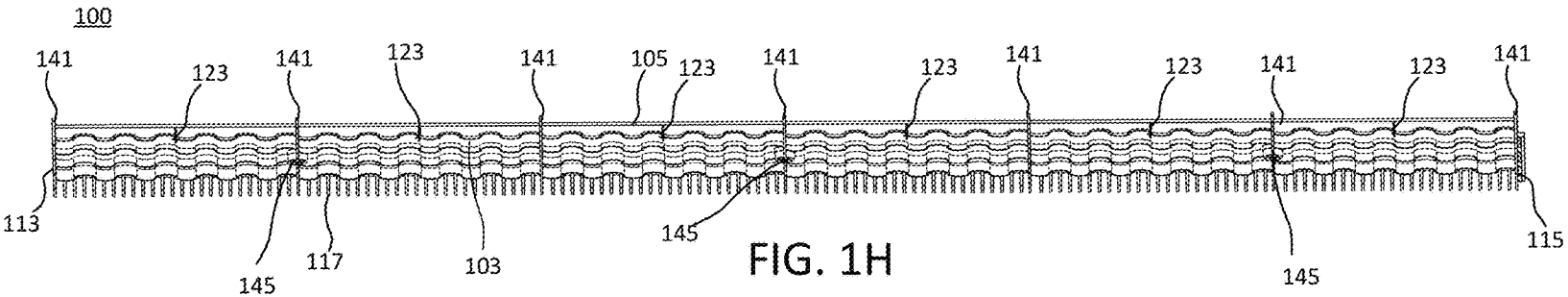
FIG. 1H is a front bottom perspective view of a roofing panel consistent with the present disclosure.
Figure 1I:
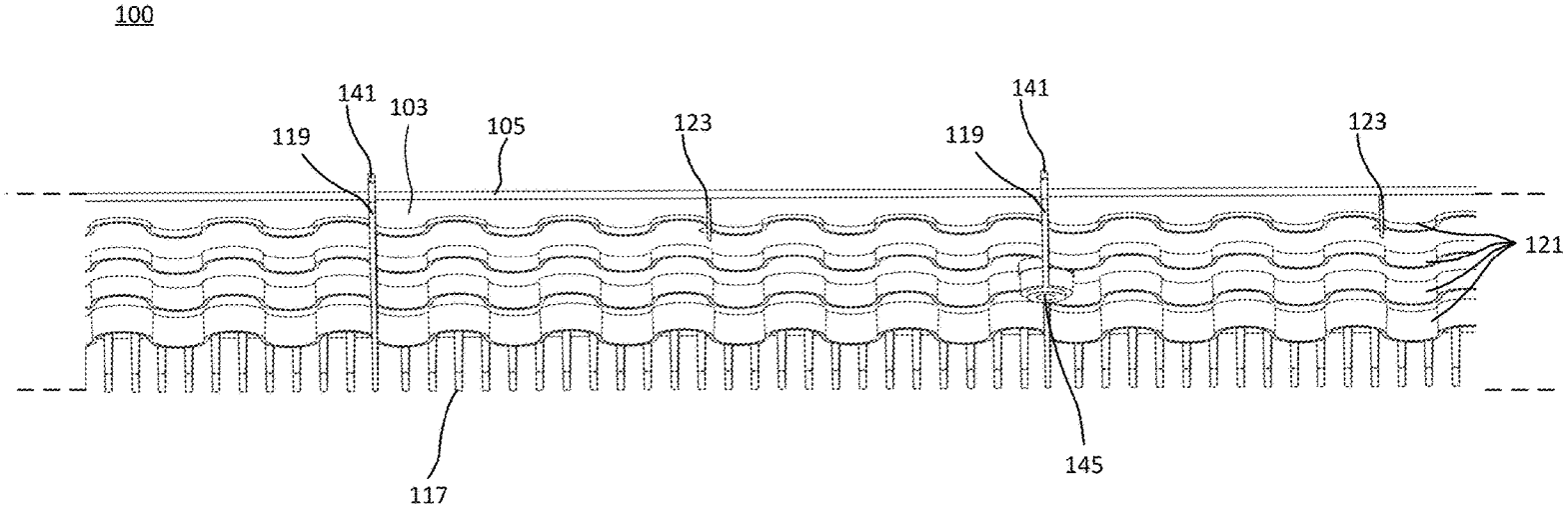
FIG. 1I is a magnified view of a region of the front bottom perspective view of FIG. 1H.
Figure 1L:
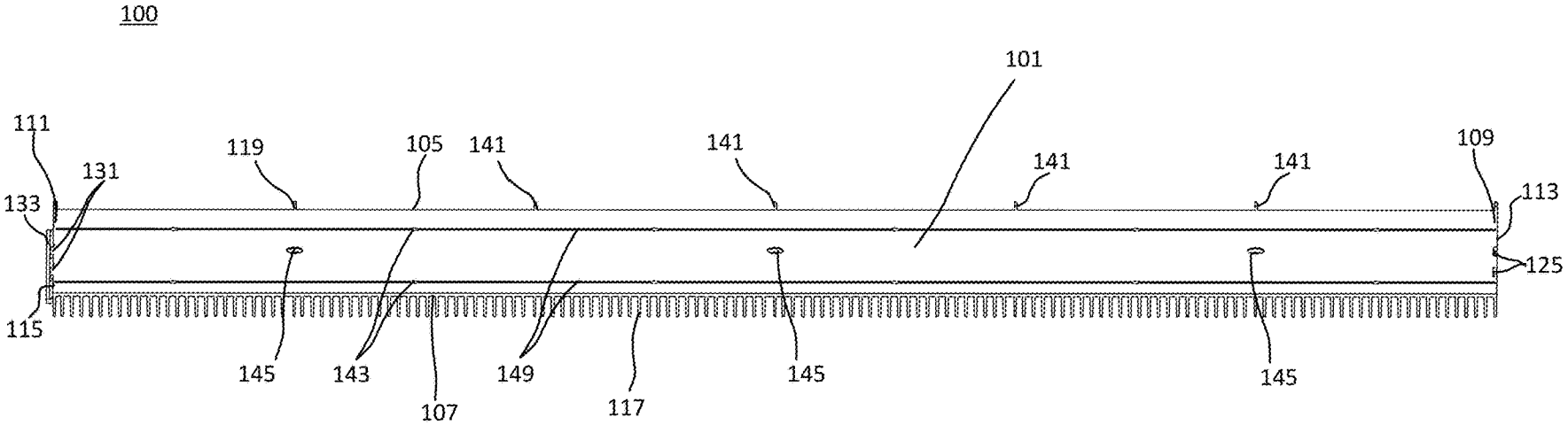
FIG. 1L is a rear top perspective view of a roofing panel consistent with the present disclosure.
Figure 1M:
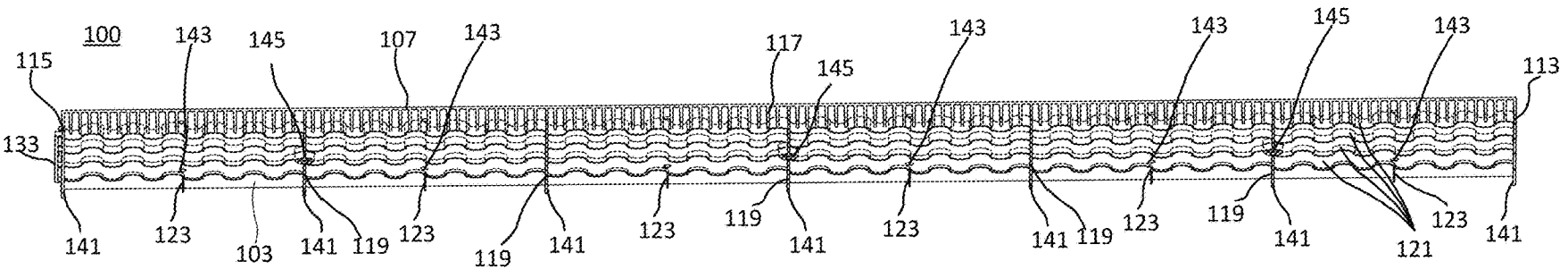
FIG. 1M is a rear bottom perspective view of a roofing panel consistent with the present disclosure.
Figure 1N:
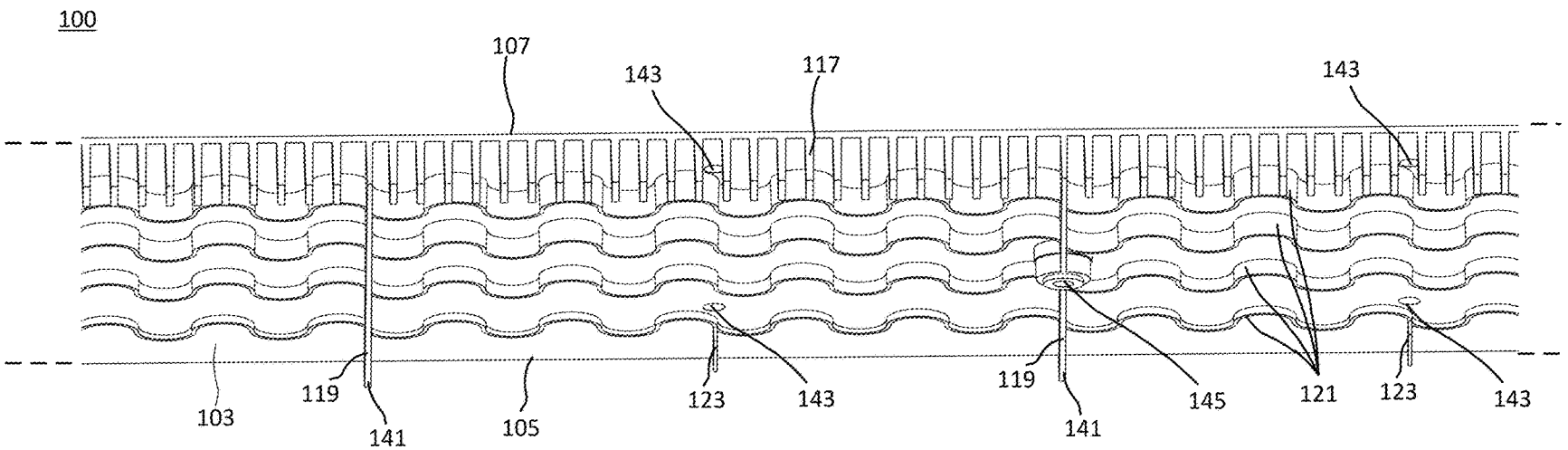
FIG. 1N is a magnified view of a region of the rear bottom perspective view of FIG. 1M.
Figure 1O:
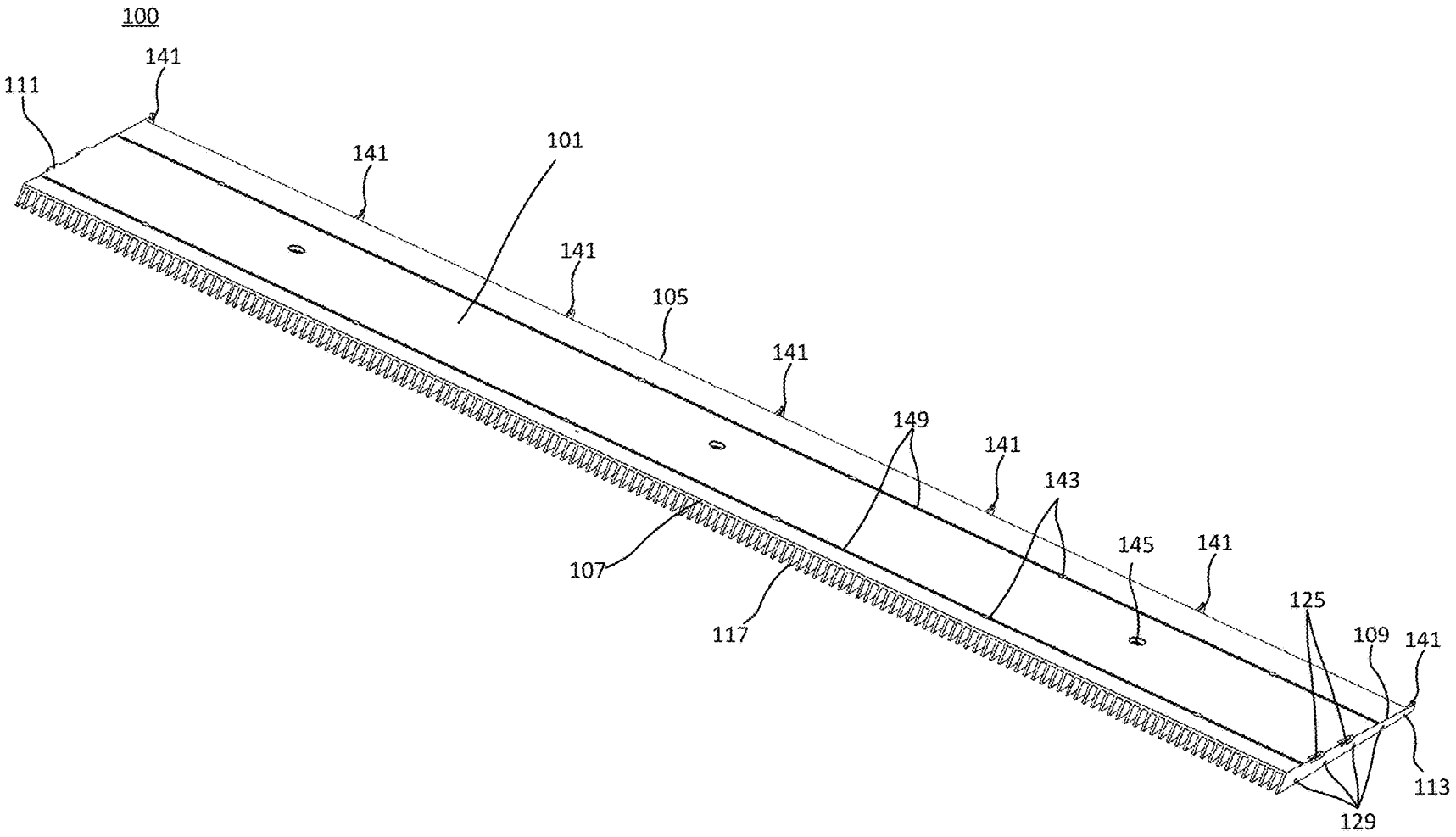
FIG. 1O is a rear right top perspective view of a roofing panel consistent with the present disclosure.
Figure 1P:
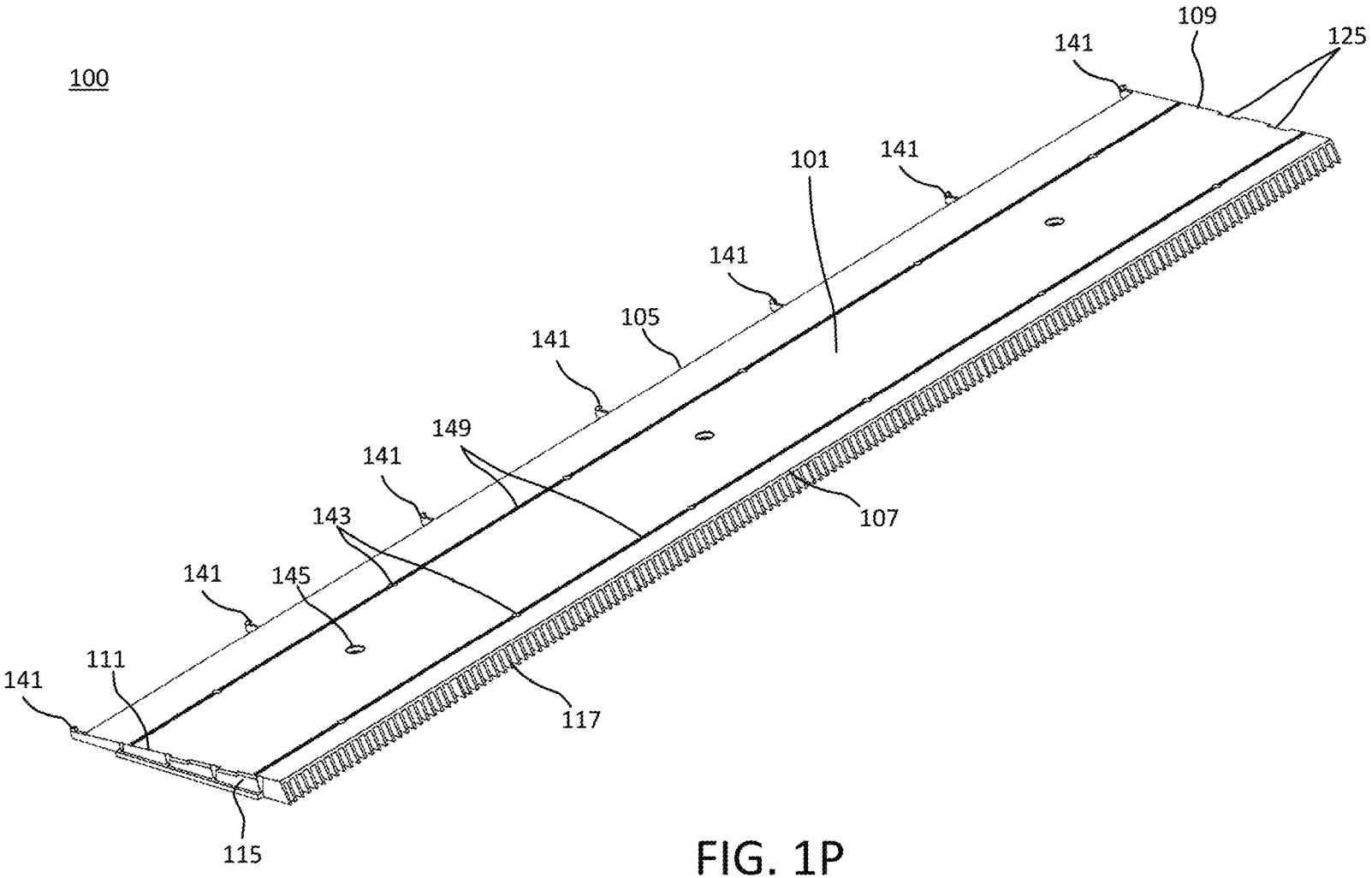
FIG. 1P is a rear left top perspective view of a roofing panel consistent with the present disclosure.
Figure 1Q:
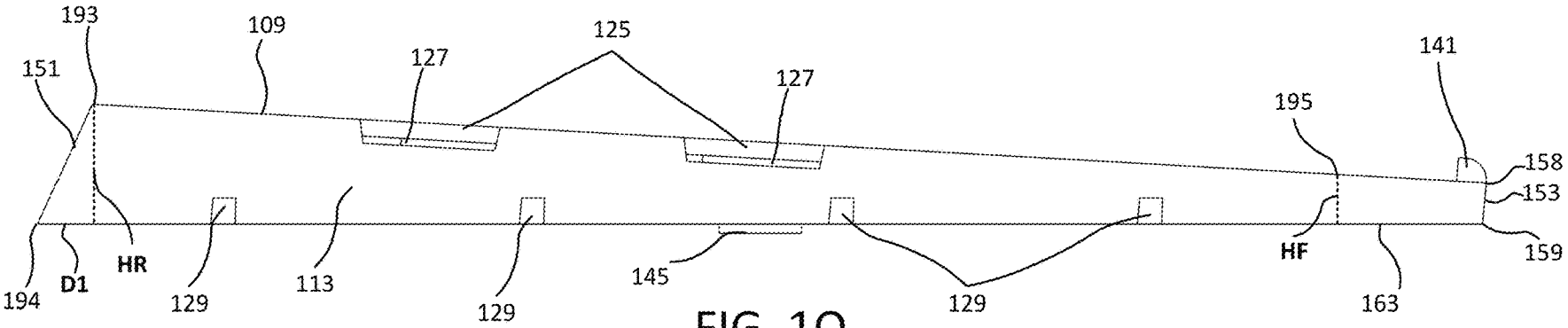
FIG. 1Q is a left side view of a roofing panel consistent with the present disclosure.
Figure 1R:
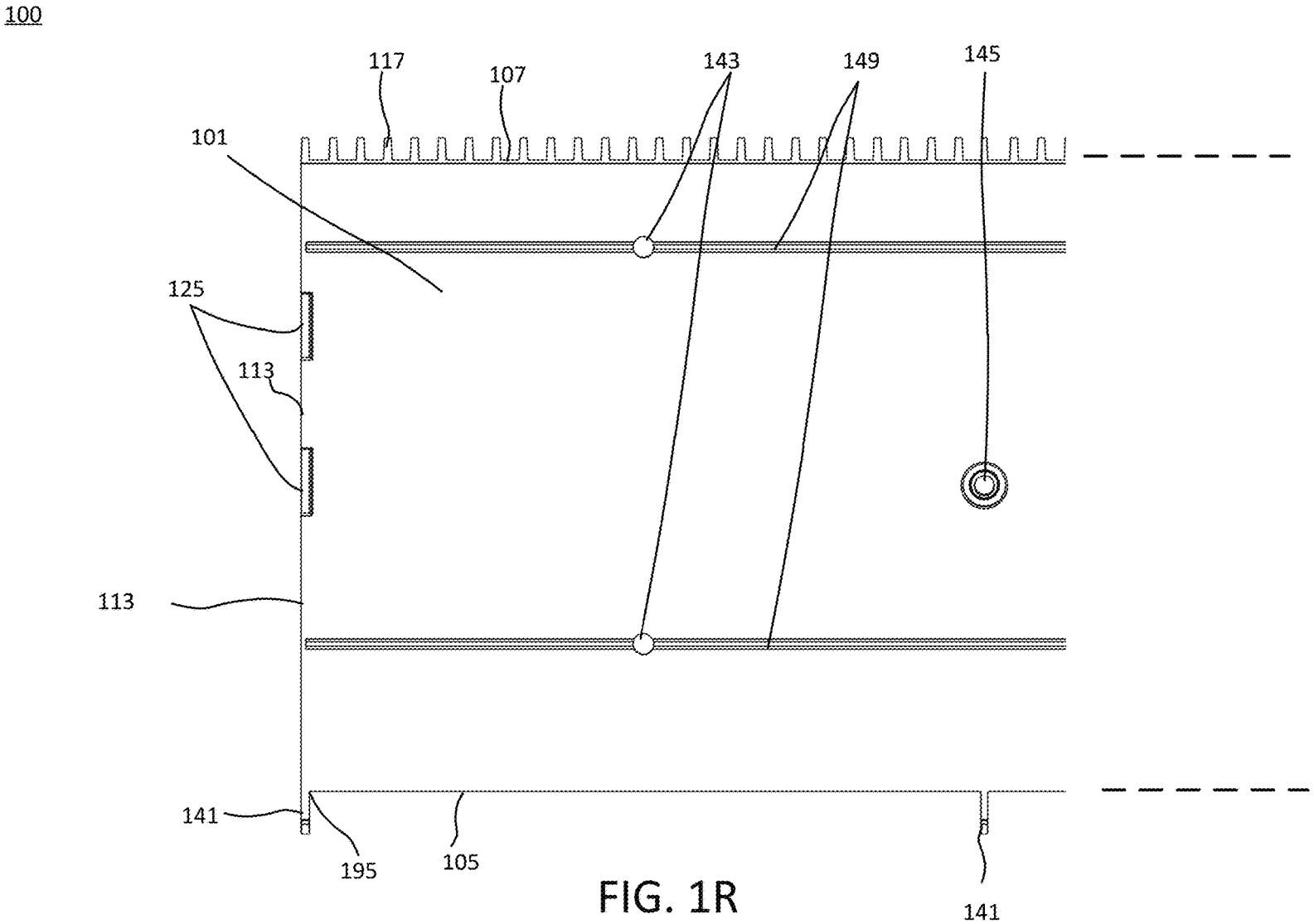
FIG. 1R is a left side top view of a roofing panel consistent with the present disclosure.
Figure 1S:
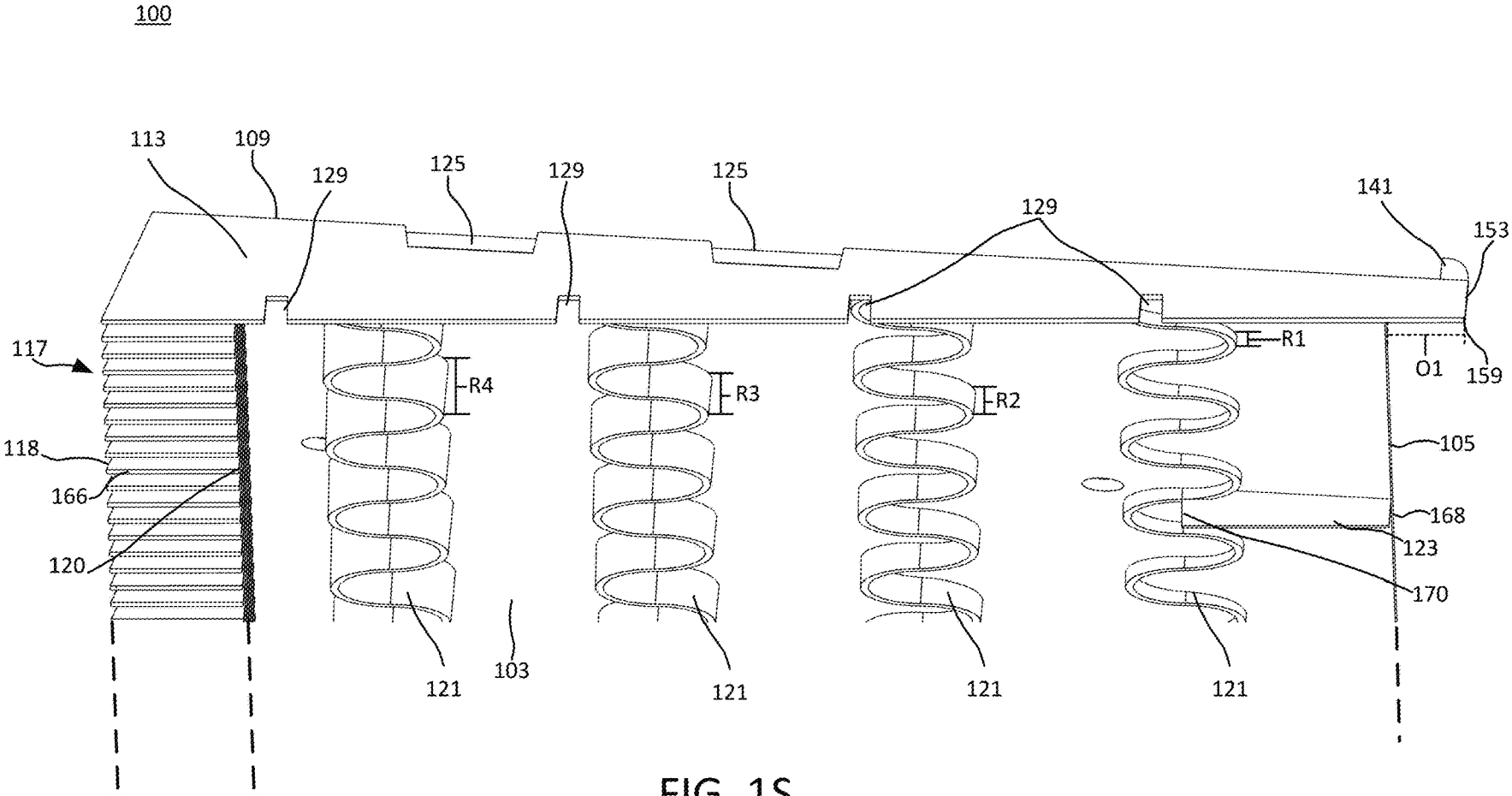
FIG. 1S is a left side bottom perspective view of a roofing panel consistent with the present disclosure.
Figure 1T:
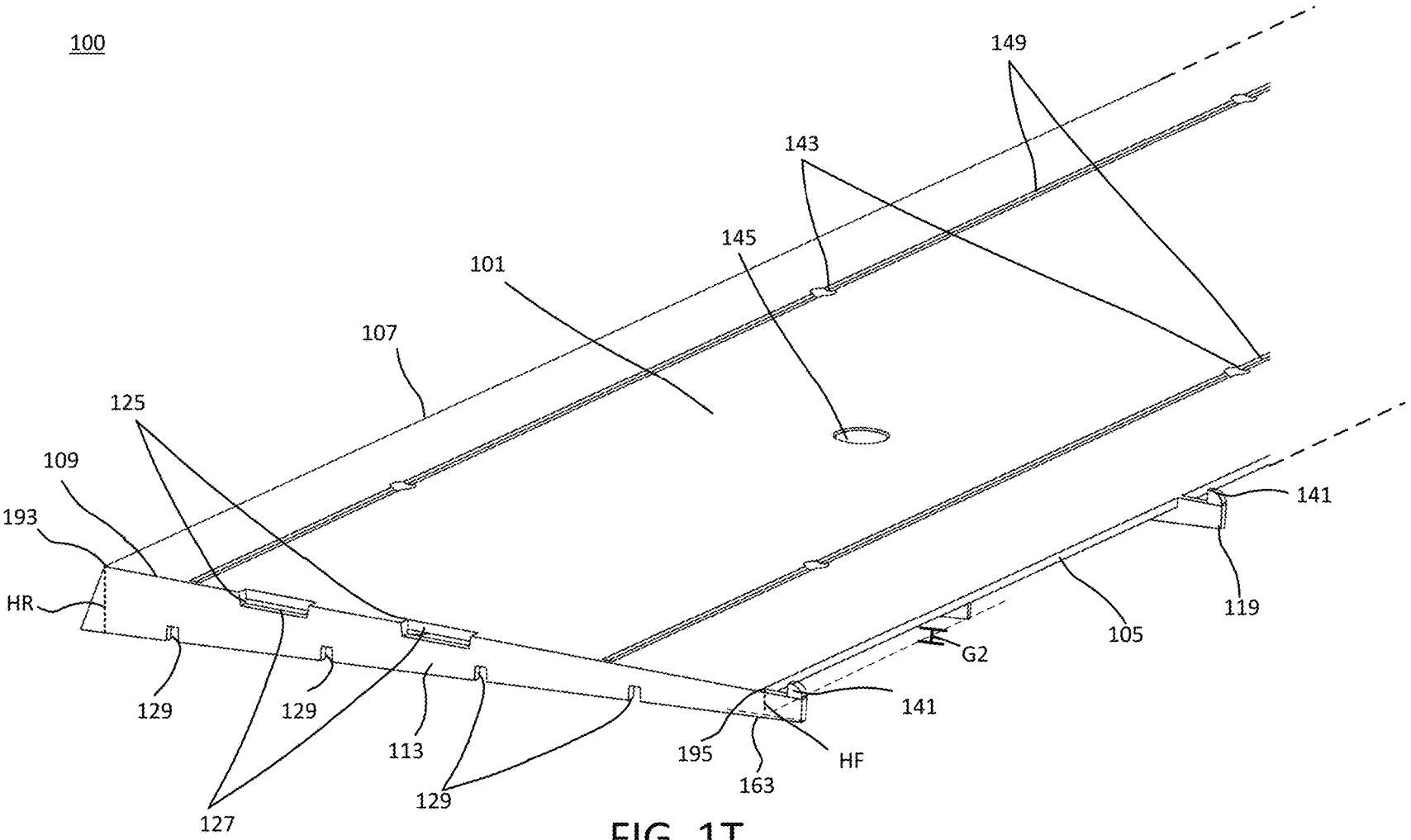
FIG. 1T is a left side top front perspective view of a roofing panel consistent with the present disclosure.
Figure 1U:
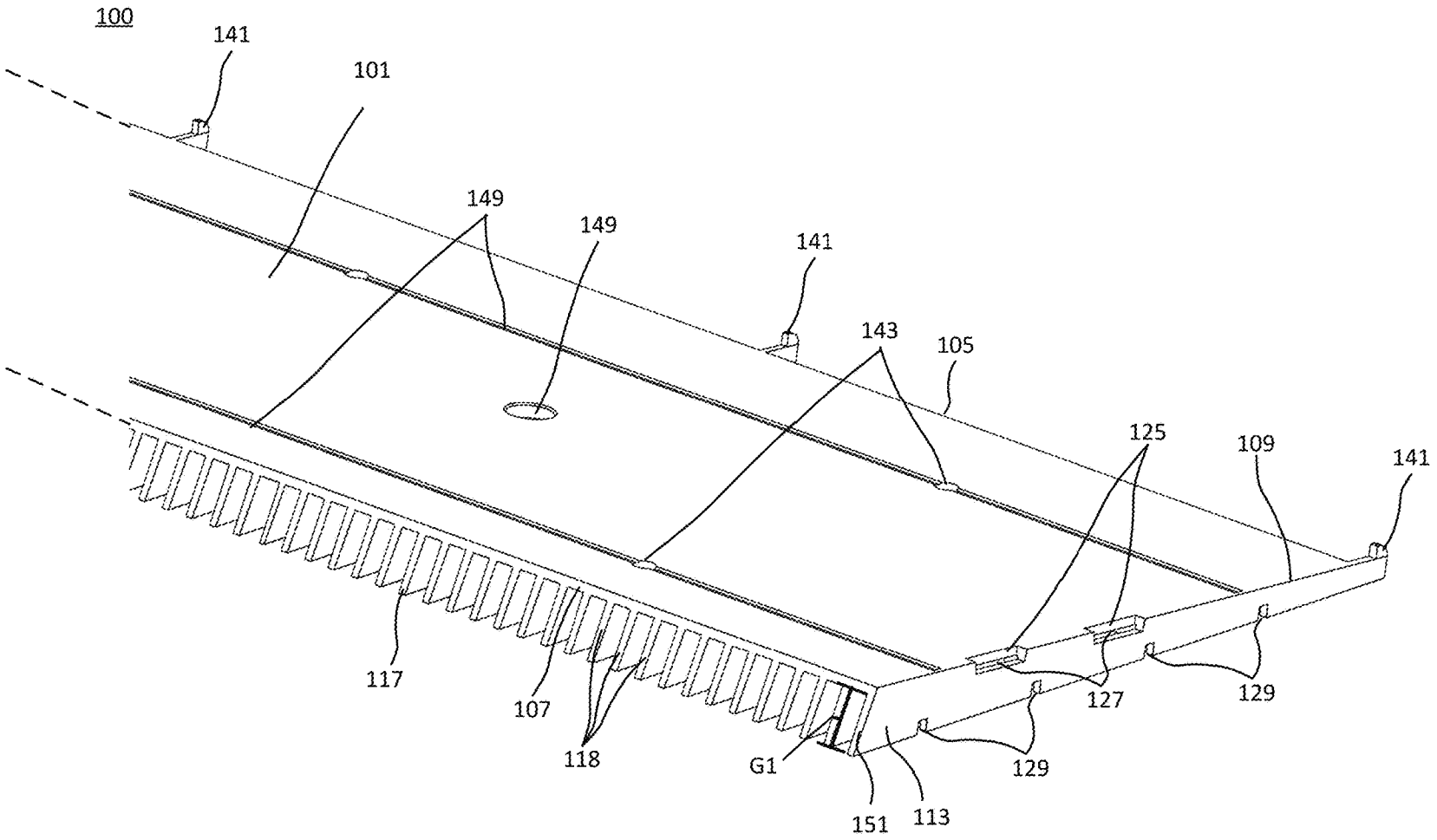
FIG. 1U is a left side top rear perspective view of a roofing panel consistent with the present disclosure.
Figure 1V:
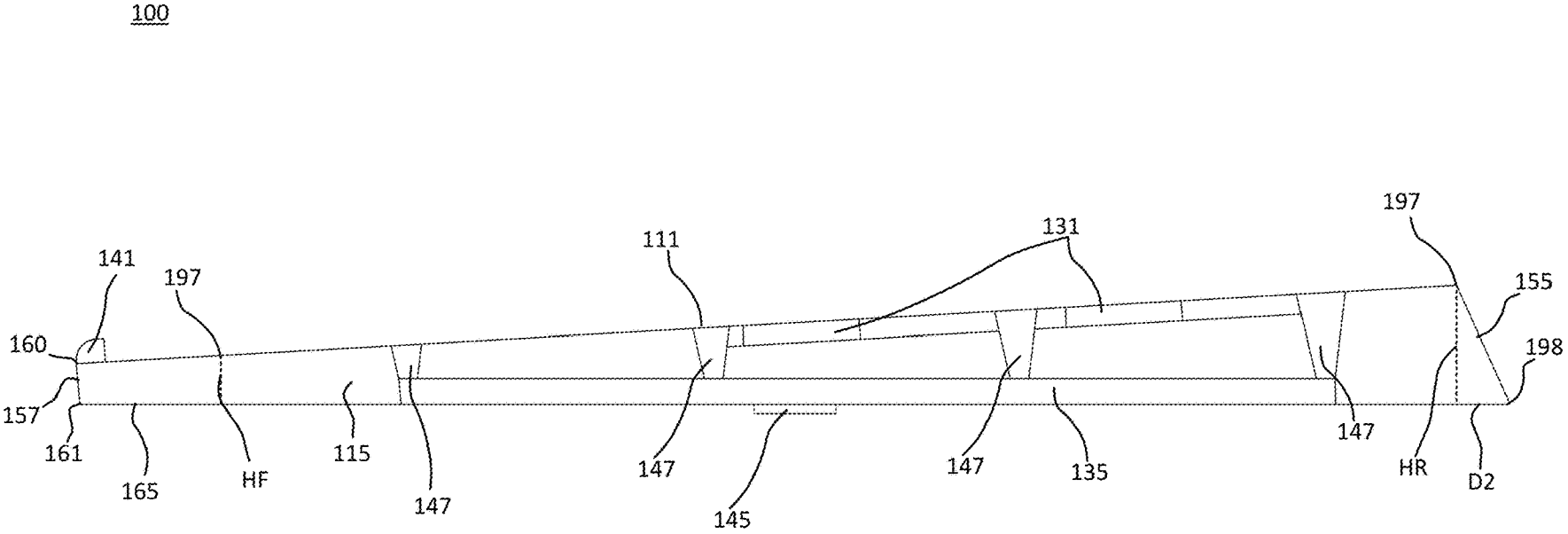
FIG. 1V is a right side view of a roofing panel consistent with the present disclosure.
Figure 1W:
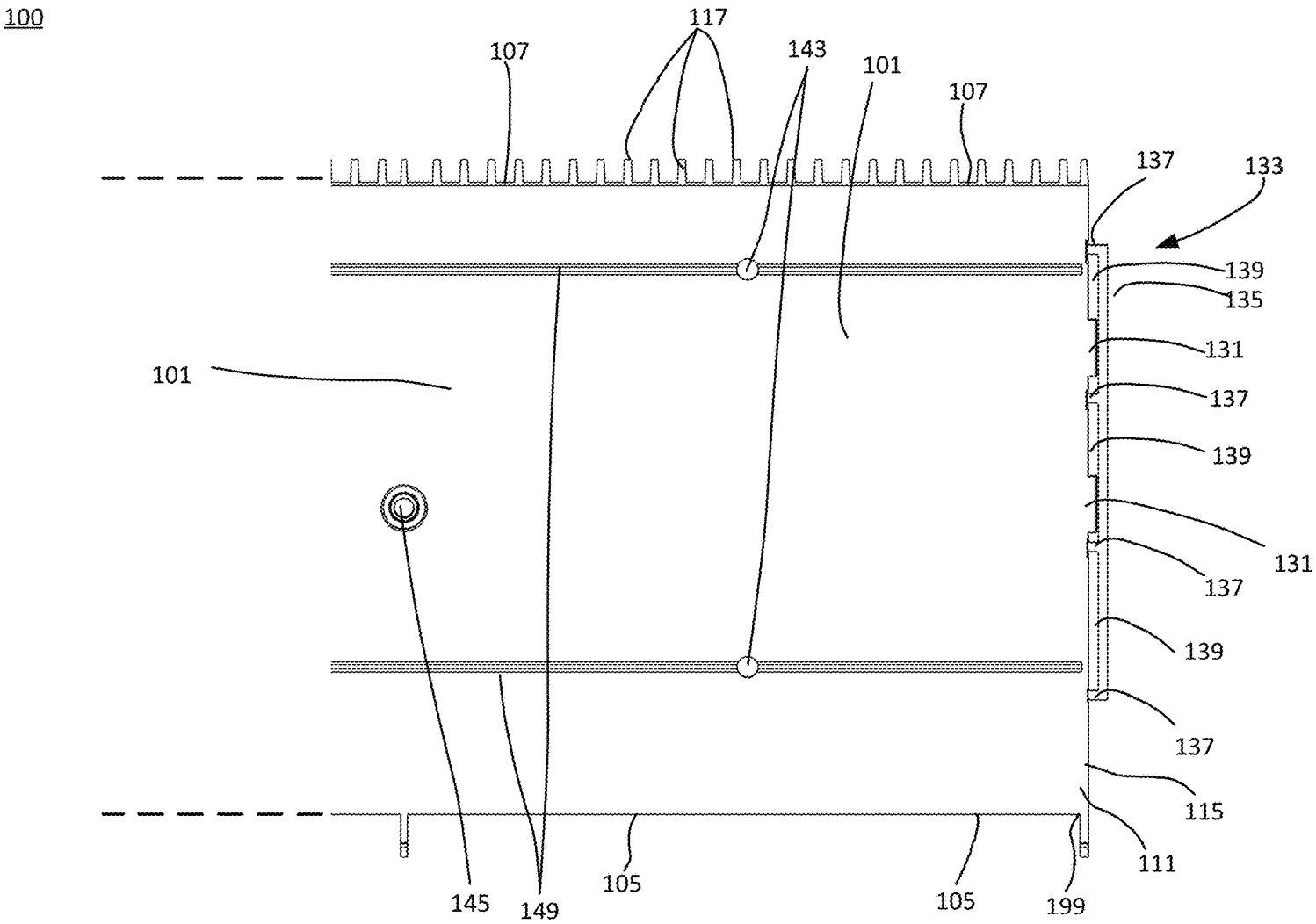
FIG. 1W is a right side top view of a roofing panel consistent with the present disclosure.
Figure 1X:
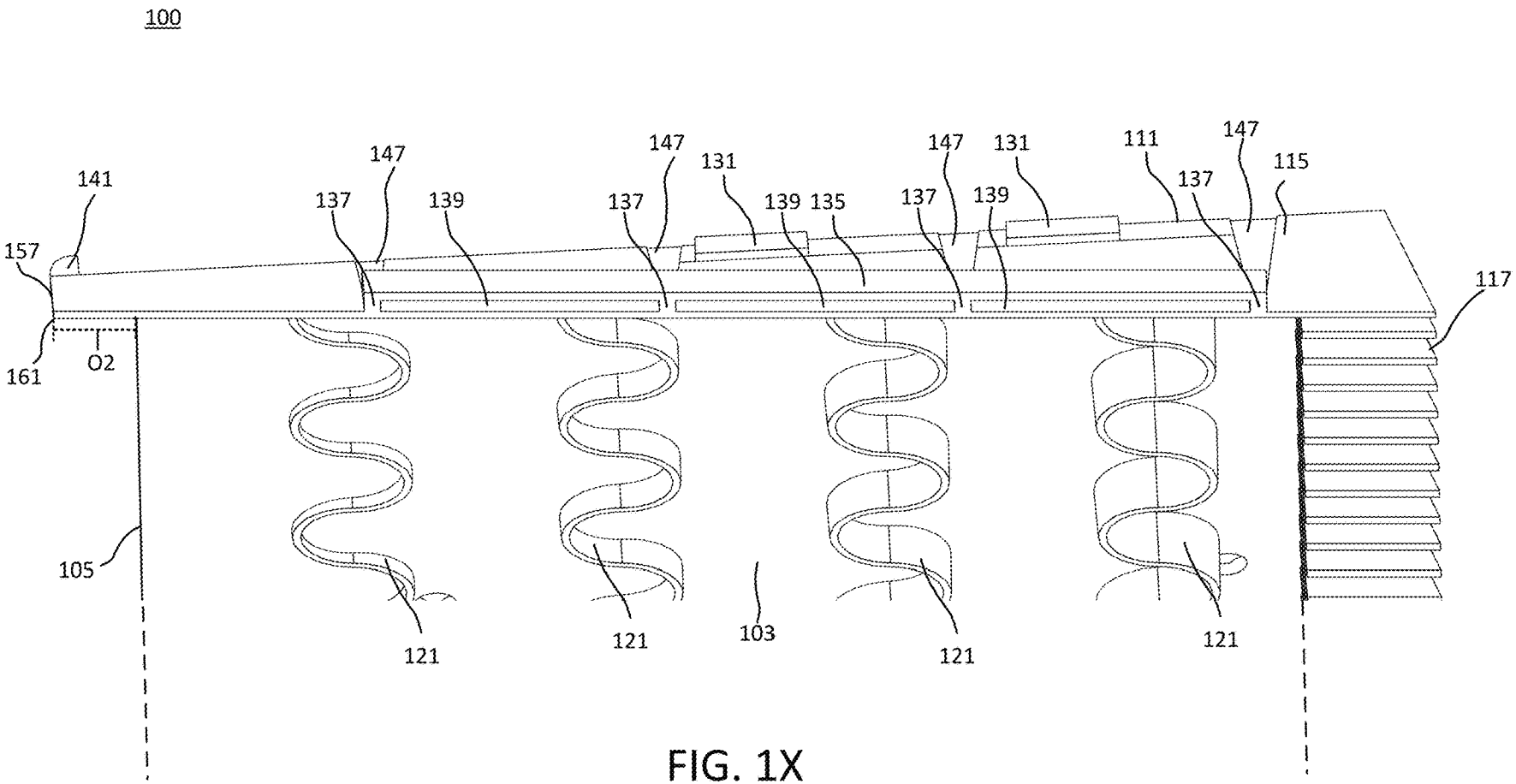
FIG. 1X is a right side bottom perspective view of a roofing panel consistent with the present disclosure.
Figure 1Y:
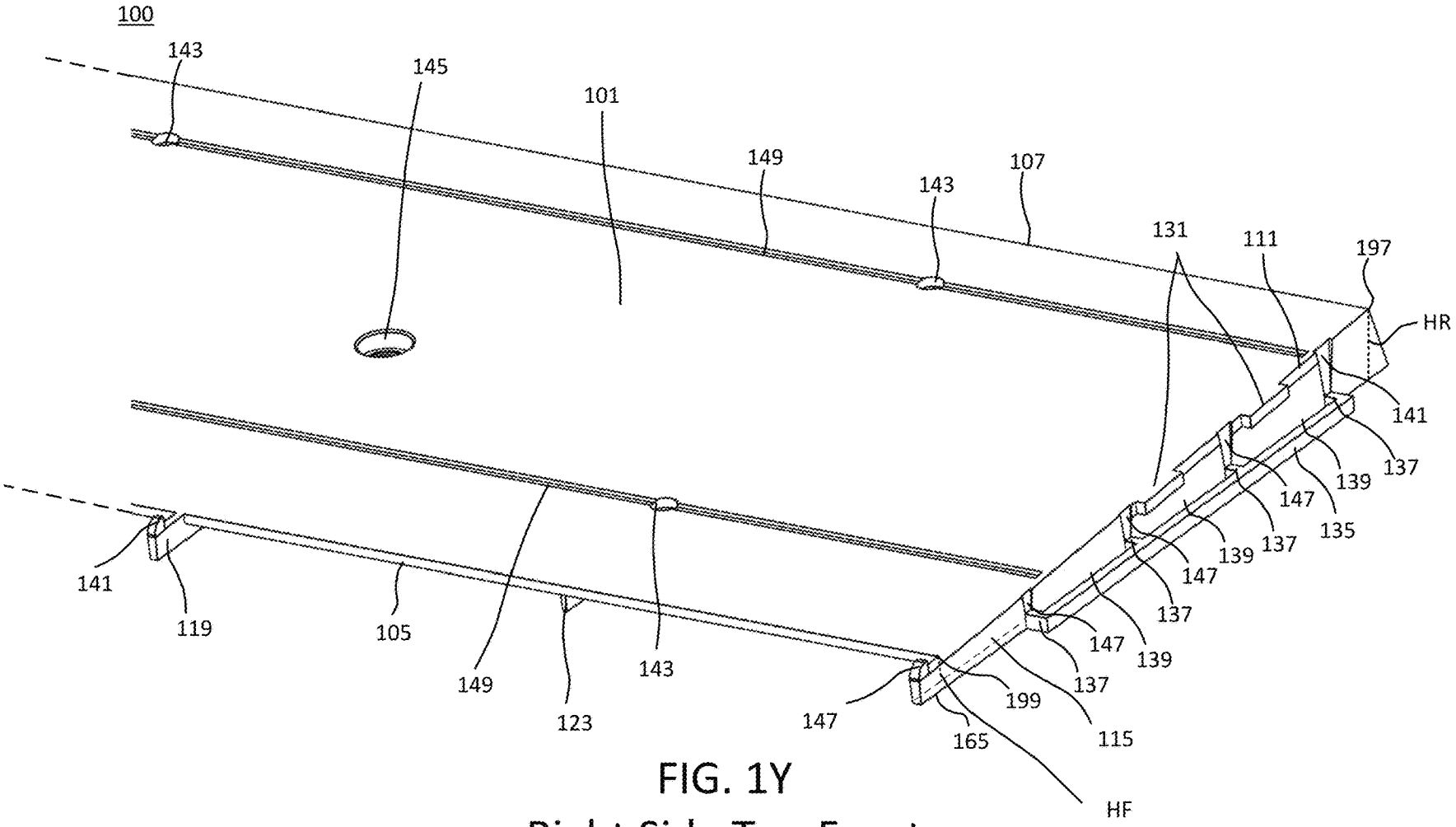
FIG. 1Y is a right side top front perspective view of a roofing panel consistent with the present disclosure.
Figure 1Z:
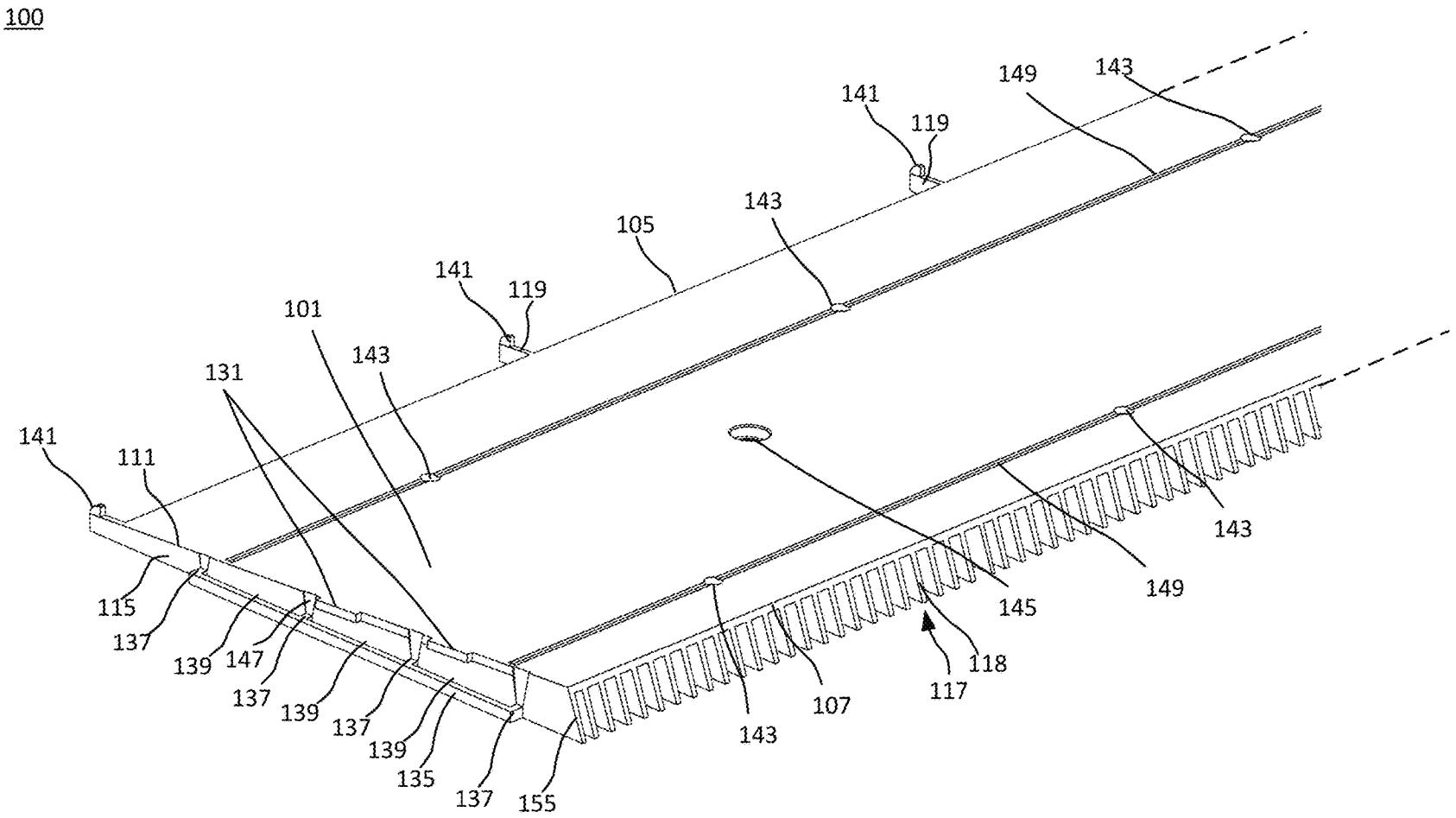
FIG. 1Z is a right side top rear perspective view of a roofing panel consistent with the present disclosure.

FIGS. 1A-1Z depict various views of one example of a roofing panel consistent with the present disclosure. As best shown in FIGS. 1A, 1D, 1F and 1I, roofing panel 100 includes body with a top side 101, a bottom side 103 parallel with top side 101, a front edge 105, a rear edge 107, a left edge 109, and a right edge 111. For clarity and ease of understanding, the present disclosure focused on embodiments in which the body of roofing panel 100 has a generally rectangular shape (i.e., in which left edge 109 is parallel to right edge 111 and front edge 105 is parallel to rear edge 107) but that configuration is not required. Indeed, the present disclosure encompasses embodiments in which the body of roofing panel 100 has any suitable geometric or irregular shape. In embodiments, the body of roofing panel 100 has a geometric shape with a plurality of sides, wherein the number of sides ranges from 3, 4, 5, 6, 7, 8, 9, or more. For example, the body may have a generally triangular, square, rectangular, trapezoidal, pentagonal, hexagonal, etc. shape. That being said, the embodiment of FIGS. 1A-1Z includes a body with four edges (sides) and a generally rectangular profile as it is configured for use with roofing (e.g., shingles) that has a quadrilateral (e.g., square, rectangular, etc.) shape.

As further shown in various FIGS., roofing panel 100 also includes a first sidewall 113 and a second sidewall 115. First and second sidewalls 113, 115 may also be referred to as "left side 113" and "right side 115," as they are illustrated on those sides of the embodiment of roofing panel 100 depicted in FIGS. 1A-1Z. The roofing panels described herein are not limited to the illustrated configuration, however, and the features of first sidewall 113 and second sidewall 115 may be reversed. That is, features of second sidewall 115 may be used on first sidewall 113, and vice versa.

First sidewall 113 and second sidewall 115 each extend from the bottom side 103 of the body of roofing panel 100. In embodiments and as best shown in FIGS. 1B, 1F, and 1G, first sidewall 113 and second sidewall 115 are each preferably oriented perpendicular or substantially perpendicular to the body of roofing panel 100 or, more particularly, to bottom side 103. In any case, first sidewall 113 includes a first sidewall distal end 151 and a first sidewall proximal end 153. In the illustrated embodiment and as best shown in FIGS. 1F and 1Q, first sidewall distal end 151 is located proximate to rear edge 107, and first sidewall proximal end 153 is located proximate to front edge 105. Similarly, second sidewall 115 includes a second sidewall distal end 155 and a second sidewall proximal end 157. As best shown in FIGS. 1G and 1V, second sidewall distal end 155 is located proximate to rear edge 107, and second sidewall proximal end 157 is located proximate to front edge 105.

In embodiments and as best shown in FIGS. 1Q and 1V, first sidewall 113 and second sidewall 115 may each have a generally quadrilateral (e.g., trapezoidal) shape when viewed from a side of roofing panel 100. Such a configuration is not required, however, and first sidewall 113 and second sidewall 115 may have any suitable shape when viewed from a side of roofing panel 100. For example, first and second sidewalls 113, 115 may have any suitable geometric or irregular shape, such as a triangular, quadrilateral, pentagonal, or other shape, provided that its sidewall height tapers in the manner described later.

First and second sidewalls 113, 115 preferably each have a generally trapezoidal shape as shown in FIGS. 1Q and 1V. In such embodiments and as shown in FIG. 1Q, the first sidewall distal end 151 may extend from a point 193 at an intersection with rear edge 107 to a point 194 on a lower edge of first sidewall 113 that extends beyond rear edge 107. That is, the first sidewall distal end 151 may extend at an angle between points 193 and 194, such that point 194 is laterally offset from point 193 by a distance D1. More specifically, in such embodiments the angle between first sidewall distal end 151 and top side 101 may be greater than or equal to 90 degrees, such as between 90 and 130 degrees. Similarly and as shown in FIG. 1V, in such embodiments the second sidewall distal end 155 may extend from a point 197 at an intersection with rear edge 107 to a point 198 on a lower edge of second sidewall 115 that extends beyond rear edge 107. That is, the second sidewall distal end 155 may extend at an angle between points 197 and 198, such that point 198 is laterally offset from point 197 by a distance D2, where D2 is the same or different from D1. More specifically, in such embodiments the angle between second sidewall distal end 155 and top side 101 may be greater than or equal to 90 degrees, such as between 90 and 130 degrees. In embodiments, D1 equals or substantially equals D2.

When first and second sidewall distal ends 151, 155 are configured in the manner shown in FIGS. 1A-1Z, the distance D1 and D2 may be selected to provide a gap between roofing panel 100 (or, more specifically, standoffs 117 described below) and roofing that's located above (i.e., upstream) of roofing panel 100. As will become apparent, when roofing panel 100 is installed on a roof and over a biocidal source, that gap can provide a mechanism to allow water or other fluid to flow into one or more channels between standoffs 117 and over the biocidal source. In non-limiting embodiments D1 and D2 each range from greater than 0 to about 2 inches (50.8 millimeters (mm)), such as from about 0.25 to about 1 inches (6.4 to 25.4 (mm)).

Of course, the present disclosure is not limited to embodiments in which first and second sidewall distal ends 151, 155 are configured as shown in FIGS. 1A-1Z. For example, in embodiments first and/or second sidewall distal ends are configured such that point 194 is disposed directly below point 193, and point 198 is disposed directly below point 197, in which case D1 and/or D2 equals zero. In those embodiments, the height of the first and second sidewall distal ends 151, 155 (i.e., the distance between points 193 and 194 and between points 197 and 198) may be set such that points 193, 194 are above an upper surface of roofing that is above/upstream of roofing panel 100, thus allowing fluid to flow into channels between one or more standoffs 117, as described later.

As also shown in FIG. 1Q, the first sidewall proximal end 153 may extend from a point 158 at an intersection between an upper side of first sidewall 113 and first sidewall proximal end 153 to a point 159 at an intersection between a lower side 163 of first sidewall 113 and first sidewall proximal end 153. In the illustrated embodiment, first sidewall proximal end 153 is oriented at a less than 90 degree angle (e.g., less than 90 degrees to about 45 degrees) relative to the top surface of first sidewall 113, such that point 158 is laterally offset from point 159.

Similarly and as shown in FIG. 1V, second sidewall proximal end 157 may extend from a point 160 at an intersection of an upper side of second sidewall 115 with second sidewall proximal end 157 to a point 161 at an intersection of a lower side 165 of second sidewall 115 and second sidewall proximal end 157. That is, the second sidewall proximal end 157 may extend at a less than 90 degree angle (e.g., less than 90 degrees to about 60 degrees) between points 160 and 161, such that point 160 is laterally offset from point 161. More specifically, in such embodiments the angle between second sidewall distal end 155 and top side 101 may be greater than or equal to 90 degrees, such as between 90 and 130 degrees. In embodiments, D1 equals or substantially equals D2.

Of course, the present disclosure is not limited to embodiments in which first and second sidewall proximal ends 153, 157 are configured as shown in FIGS. 1A-1Z. In embodiments, first and/or second sidewall proximal ends 153, 157 are flat and are configured such that point 159 is disposed directly below point 158 and point 161 is disposed directly below point 160. In such instances, first sidewall proximal end 153 may be oriented perpendicular or substantially perpendicular to the lower side of first sidewall 113, and second sidewall proximal end 157 may be oriented perpendicular or substantially perpendicular to the lower side of second sidewall 115.

As further shown in FIGS. 1Q and 1V, first and second sidewalls 113, 115 each have a sidewall height, wherein the sidewall height is relatively thick near rear edge 107, and is relatively thin near front edge 105. More specifically, first and second sidewalls 113, 115 may have respective first and second sidewall heights that taper from a rear height (HR) proximate rear edge 107 to a front height (HF) proximate front edge 105. While the present disclosure focuses on embodiments wherein the first and second sidewall heights mirror one another (i.e., taper from HR to HF in the same manner), such a configuration is not required, and the first and second sidewall heights may differ from one another as desired.

As shown in FIG. 1Q, the rear height HV of first sidewall 113 is defined as the shortest distance between a point 193 of intersection between first sidewall 113 and rear edge 107, and lower side 163 of first sidewall 113. Likewise as shown in FIG. 1V, the rear height HV of second sidewall 115 is defined as the shortest distance between a point 197 of intersection between second sidewall 115 and rear edge 107, and lower side 165 of second sidewall 115. In embodiments where D1 is zero and first sidewall distal end is flat, HR of first sidewall 113 is the same as the length of first sidewall distal end 151. Likewise when D2 is zero and second sidewall distal end 155 is flat, HR of second sidewall 115 is the same as the length of second sidewall distal end 155. In any case, the HR of the first and second sidewalls 113, 115 may be the same or different, and may range from greater than 0 to about 3 inches, such as greater than 0 to about 2.5 inches (63.5 mm), about 0.25 inches (6.35 mm) to about 1.5 inches (38.1 mm), or even about 0.25 inches (6.35 mm) to about 1 inches (25.4 mm). In embodiments, HR of the first and second sidewalls 113, 115 is the same, and is within the aforementioned ranges.

As shown in FIGS. 1R and 1T, the front height HF first sidewall 113 is defined as the shortest distance between a point 195 at an intersection of front edge 105 and first sidewall 113 and lower side 163 of first sidewall 113. Likewise and as shown in FIGS. 1W and 1Y, the front height HF of second sidewall 115 is defined as the shortest distance between a point 199 at an intersection of front edge 105 and second sidewall 115 and lower side 165 of second sidewall 115.

As noted above the first sidewall height and second sidewall height may taper from HR to HF in the same or different manner. In embodiments the first and second sidewall heights taper in the same manner (i.e., mirror one another), such that first and second sidewalls 113, 115 change in height in the same manner Put differently, in embodiments the distance (height) at any point along an upper edge of first sidewall 113 and lower side 163 may equal the distance (height) at corresponding points along an upper edge of second sidewall 115 and lower side 165. Preferably, the first and second sidewall heights taper in the same manner, and taper linearly between HR to HF.

As will be discussed below, features such as one or more coupling elements may be coupled to or integral with first and second sidewalls 113, 115. For example, in embodiments one or more female coupling elements 125, 129 may be coupled to and/or formed in first sidewall 113, and one or more male coupling elements 131, 133 may be coupled to any/or formed in second sidewall 115. In such instances, the first and second sidewall height refers to the distance between a straight line projected along an upper edge of the first sidewall 113 or the second sidewall 115, and a straight line projected along an edge of the corresponding lower side 163, 165 of such sidewalls. More specifically, in such instances the first sidewall height refers to the distance between a straight line projected between points 158 and 193 and a straight line projected between points 159 and 194 in FIG. 1Q. Likewise, in such instances the second sidewall height refers to the distance between a straight line projected between points 160 and 197 and a straight line projected between points 161 and 198 in FIG. 1V. In either case, the projected straight lines pass across any gaps, depressions, etc. and/or through any features that may be present on or within first and second sidewalls 113, 115.

In embodiments, HR and HF are selected such that a space is present between bottom side 103 and roofing or a biocidal source disposed below roofing panel 100 when roofing panel 100 is installed. More specifically, when roofing panel 100 is installed on a roof, lower sides 163, 165 of first and second sidewalls 113, 115 may contact underlying roofing and/or a biocidal source. In such instances, HR may be selected to provide a space (i.e., a gap G1) between the bottom side 103 and the underlying roofing/biocidal source proximate rear edge 107 (i.e., on an upstream side of roofing panel 100) as shown in FIGS. 1K and 1U. Likewise, HF may be selected to provide a space (i.e., a gap G2) between the bottom side 103 and the underlying roofing/biocidal source proximate front edge 105 (i.e., on a downstream side of roofing panel 100), as shown in FIG. 1T. In operation, water flowing down the roof may enter into the space G1 provided by HR ((and/or one or more standoffs 117, as described later) on the upstream side of roofing panel 100 (i.e., proximate rear edge 107), and may flow downwards (over the underlying roofing and/or biocidal source) towards front edge 105. Ultimately, the water may emerge from the space G2 provided by HF (and/or one or more tapered spacers 119, described later) and continue to flow downstream of roofing panel 100.

HR and HF may be any suitable height, provided they are greater than 0. In embodiments, HR and HF are the same (in which case first and second sidewalls 113, 115 may not taper), and range from greater than 0 to about 2.5 inches (63.5 mm), such as from greater than 0 to about 1.5 inches (38.1 mm), or even about 0.0625 inches (1.5 mm) to about 0.75 inches (19 mm). In other embodiments, HR and HF differ from one another, and are within the aforementioned ranges. Preferably, HR is greater than HF, and HR and HF are within the aforementioned ranges. For example, in embodiments HR is in the range of greater than or equal to 0.125 inches to about 2.5 inches, HF is in the range of greater than or equal to 0.0625 to about 1 inches, and HF is less than HR. In preferred embodiments, HR is in the range of 0.25-0.5 inches, and HF is in the range of less than 0.25 inches to about 0.625 inches. In those or other embodiments, the ratio of HR to HF may range from about 1:1 to about 5:1 or more. Preferably, the ratio of HR to HF ranges from about 1.25:1 to about 3:1.

In the illustrated embodiments and as best shown in FIGS. 1S and 1X, first and second sidewalls 113, 115 extends past front edge 105. More specifically and as shown in FIG. 1S, first sidewall proximal end 153 may extend past front edge 105 by an offset distance O1. Likewise and as shown in FIG. 1X, second sidewall proximal end 157 may extend past front edge 105 by an offset distance O2, which may be the same or different from O1. In embodiments O1 and O2 are the same, and are selected such that the distance between first and second sidewall proximal ends 153, 157 (or an abutment surface of a roofing retention element 141 thereon) and rear edge 107 is about the same as one or more dimensions of a roofing material to be installed on top side 101. With that in mind, the distance between first and second sidewall proximal ends 153, 157 (or an abutment surface of a roofing retention element 141 thereon) and rear edge 107 may range from about 2 to about 12 inches or more. Without limitation, in embodiments the distance between first and second sidewall proximal ends 153, 157 (or an abutment surface of a roofing retention element 141 thereon) and rear edge 107 is about 4 to about 8 inches, such as about 6 inches. Such distance may correspond to a width or length of a profile portion of a standard roofing shingle.

As mentioned above, when roofing panel 100 is installed on a roof, roofing (e.g., one or more roofing shingles) may be coupled to the top of top side 101 so as to conceal roofing panel from view. Such roofing may be coupled to the top side 101 in any suitable manner, such as via an adhesive, one or more mechanical fasteners, or a combination thereof. Preferably, roofing such as a roofing shingle is coupled to top side 101 via an adhesive. IN such instances, roofing panel 100 may include one or more features that maintain the position of roofing that is applied to top side 101 with an adhesive until the adhesive cures. More specifically and as shown in various FIGS., roofing panel 100 may include one or more roofing retention elements 141. When used, roofing retention elements 141 may be positioned at any suitable location for retaining and/or aligning roofing on the top side 101 of roofing panel 100. In the embodiment of FIGS. 1A-1Z, roofing retention elements 141 are coupled to or integral with an upper side of first and second sidewalls 113, 115, and are positioned near first and second sidewall proximal ends 153, 157. Alternatively or additionally, roofing retention elements 141 may also be disposed on an upper side of one or more tapered spacers 119, which are described in further detail below.

In the illustrated embodiment, roofing retention elements 141 include a generally flat abutment surface that is oriented to face front edge 105 and/or rear edge 107, and a curvilinear surface that is oriented away from front edge 105 and/or rear edge 107. In use, the abutment surface may abut an edge of roofing applied to top side 101. As roofing panel 100 will typically be installed on a roof with front edge 105 below rear edge 107, movement of roofing applied to top side 101 may be limited and/or prevented by the interaction of the relatively flat abutment surface of the roofing retention elements 141 and an edge of the roofing.

Although the roofing retention elements 141 are useful in the illustrated configuration, the present disclosure is not limited thereto. Indeed, the present disclosure encompasses embodiments in which roofing retention elements 141 are of any suitable shape, and include 1 or more abutment surfaces of any suitable configuration. For example, roofing retention elements 141 may be in the form of a geometric or irregular shaped post having one or more sides (e.g., a circular post, triangular post, quadrilateral post, pentagonal post, star shaped post, etc.), wherein the post is coupled to or is integral with an upper side of first and second sidewalls 113, 115 and/or an upper side of a tapered spacer 119. Alternatively or additionally, roofing retention elements 141 may be in the form of a hook or barb that is coupled to or integral with an upper side of first and second sidewalls 113, 115 and/or an upper side of a tapered spacer 119.

Roofing panel 100 further includes a plurality of standoffs 117, as shown in FIGS. 1A-1C, 1H-1P, 1S, 1U-X, and 1Z. As best shown in FIGS. 1C, 1K, 1N, 1P, 1U, and 1Z standoffs 117 each extend from (i.e., are coupled to or are integral with) bottom side 103 of the body of roofing panel 100, and include a standoff distal end 118. In the illustrated embodiment standoff distal end 118 is oriented substantially in parallel with first and second sidewall distal ends 151, 155, such that each standoff distal end 118 lies in substantially the same plane as first and second sidewall distal ends 151, 155. Moreover, in the illustrated embodiment each standoff 117 has a standoff height (between a point at the intersection between a sidewall of standoff 117 and bottom side 103 and a corresponding point at the intersection between the same sidewall of standoff 117 and lower side 166), wherein the standoff height is the same or substantially the same as the gap G1 provided by first and second sidewalls 113, 115. And still further, in the illustrated embodiment the standoff height tapers in the same manner as the first sidewall height, the second sidewall height, or both, such that any point along lower side 166 of a standoff 117 lies in the same or substantially the same plane as a corresponding point along lower sides 163, 165 of first and second sidewalls 113, 115, respectively. Put differently, in the illustrated embodiment standoffs 117 are configured to maintain the gap G1 between the bottom side 103 and material (e.g., roofing or a biocidal source) underlying roofing panel 100 when roofing panel 100 is installed.

The number of standoffs 117 used is not limited, and any suitable number of standoffs may be used. For example, the number of standoffs 117 may be 0 (in which case standoffs 117 are optional), or greater than 0. When greater than 0, the number of standoffs 117 may range from 1 to 1000 or more, such as from 1 to 500, 1 to 100, or 1 to 50. In embodiments, the number of standoffs 117 that are used depends on the distance between an inward facing side of first and sidewalls 113, 115, the thickness of standoffs 117, and the spacing between adjacent standoffs 117 and/or a standoff 117 and an inward facing side of first sidewall 113 or second sidewall 115. In embodiments, the number of standoffs 117 is selected to adequately support the rear edge 107 of roofing panel 100, i.e., to limit or prevent sagging of rear edge 107 between first sidewall 113 and second sidewall 115.

In embodiments and as shown in FIG. 1K, a plurality of standoffs 117 are used and each standoff 117 is spaced from an adjacent standoff 117 by standoff spacing S, so as to define a channel there between. Standoff spacing S is not limited provided it allows for sufficient flow of water through the channel between adjacent standoffs, and/or between a standoff and an adjacent first or second sidewall 113, 115. Without limitation, the standoff spacing S may range from greater than 0 to about 5 inches, such as from greater than 0 to about 2.5 inches, from greater than 0 to about 1 inch, from greater than 0 to about 0.5 inches, from greater than 0 to about 0.25 inches, or even from greater than 0 to about 0.125 inches. Without limitation, standoff spacing is preferably in the range of about 0.125 inches to about 0.5 inches. Of course, a smaller or large standoff spacing may also be used.

Standoffs 117 may have any suitable thickness, and one or more sides. In embodiments, the thickness of standoffs ranges from greater than 0 to about 1 inch, such as greater than 0 to about 0.5 inches, greater than 0 to about 0.25 inches, or even greater than 0 to about 0.125 inches. Preferably, the thickness of standoffs 117 in is in the range of greater than 0 to about 0.25 inches.

Standoffs 117 may also include one or more sides, as shown in various FIGS. In the illustrated embodiments, standoffs 117 each have a first standoff side and a second standoff side, wherein the first and second standoff sides have a quadrilateral (e.g., trapezoidal) shape that is substantially the same as a corresponding portion of first sidewall 113, second sidewall 115, or both. Standoffs 117 are not limited to that configuration, however, and may include sides that are any suitable geometric or irregular shape. For example, the sides of standoffs 117 may have a triangular, quadrilateral (square, rectangular, trapezoidal, etc.), pentagonal, hexagonal, or other geometric or irregular shape.

In embodiments and as shown in FIG. 1S, standoffs 117 further include a standoff proximal end 120, which in the illustrated embodiments is located between rear edge 107 and front edge 105 of the body of roofing panel 100. That configuration is not required, however, and standoff proximal end 120 may be at any suitable position between rear edge 107 and front edge 105, or past front edge 105. In some embodiments, one or more standoffs 117 extend to or past front edge 105 of the body of roofing panel 100, such that standoff proximal end 120 is located past front edge 105. In such instances, such standoffs may form one or more tapered spacers 119, as shown in FIGS. 1B, 1C, 1H, 1I, 1M, IN, 1Y, and 1Z.

Generally, tapered spacers 119 include the same or similar features as standoffs 117. That is, like standoffs 117, tapered spacers extend from or are coupled to bottom side 103, and include a (tapered spacer) distal end, a (tapered spacer) proximal end, and a (tapered spacer) lower surface). Tapered spacers 119 differ from standoffs in that they have a spacer height that mirrors the first sidewall height and/or second sidewall height, and in that they extend such that their proximal end is located at or past front edge 105. For example and as shown in the illustrated embodiment, tapered spacers have a spacer height that tapers from HR to HF in the same or substantially the same manner as the first and second sidewall heights described above. Moreover, the proximal end of each tapered spacer 119 extends past front edge 105 by a distance that is the same or substantially the same as offset distance O1 and/or O2 (or both O1 and O2, when such distances are the same).

Tapered spacers 119 also differ in function from standoffs 117. As noted above, standoffs 117 are configured to support rear edge 107 and maintain a gap between the bottom side 103 of the body of roofing panel 100 and material underlying roofing panel 100 when it is installed. In contrast, tapered spacers 119 are configured to support and/or stiffen the body of roofing panel 100, e.g., by supporting bottom side 103 from rear edge 107 to front edge 105, or vice versa.

As further shown in various FIGS., roofing panel 100 may further include one or a plurality of reinforcements 121. In the illustrated embodiments, reinforcements 121 are in the form of four serpentine walls that extend from bottom side 103, and which extends between and is coupled to first sidewall 113 and second sidewall 115. In that configuration, each reinforcement 121 has a reinforcement height (R4, R3, R2, R1), that is less than the sidewall height measured at a point of intersection between a reinforcement 121 and first sidewall 113 and second sidewall 115, respectively. Thus, the height of the reinforcements decrease with increasing proximity to front edge 105, and increases with increase proximity to rear edge 107. For example and as shown in FIG. 1S, height R4 of a reinforcement 121 located proximate to rear edge 107 is greater than a height R3 of a reinforcement 121 located further away from rear edge 107, which is greater than a height R2 of a reinforcement 121 located even further away from rear edge 107, which is greater than a height R1 of a reinforcement 121 located still further away from rear edge 107 (i.e., R4>R3>R2>R1). In such instances, R1-R4 may be less than the first and second sidewall height, and may range from greater than 0 to about 2.5 inches, such as from greater than 0 to about 1.5 inches, greater than 0 to about 1 inches, greater than 0 to about 0.75 inches, greater than 0 to about 0.5 inches, greater than 0 to about 0.25 inches, or even greater than 0 to about 0.125 inches. Without limitation, in embodiments R1-R4 are each in the range of 0.25 to 0.75 inches, where R4>R3>R2>R1.

Of course, the present disclosure is not limited to the use of reinforcements that are configured in the manner illustrated in FIGS. 1A-1Z. Indeed, the present disclosure encompasses embodiments in which reinforcements 121 have any suitable shape and/or height. For example, reinforcements 121 may be in the form of a straight wall, a lattice of interconnected walls (e.g., two linear walls coupled by a plurality of intersecting lattice walls), rounded edge walls, combinations thereof, and the like. Moreover, reinforcements 121 may be of any height, so long as their height is less than or equal to the first and/or second sidewall height at a corresponding point along first and second sidewalls 113, 115 (i.e., measured at a point at which the reinforcement contacts the sidewall, or measured at a point on the first or second sidewall that is intersected by a line projected from a point on a reinforcement 121 that is closest to the respective sidewall 113, 115.

In the illustrated embodiment tapered spacers 119 may contact one or more or more reinforcements 121. For example and as best shown in FIG. 1C, tapered spacers may pass or otherwise extend through one or more reinforcements 121 as they extend between rear edge 107 and front edge 105. In some instances, reinforcements 121 are divided into segments, wherein each segment extends between two tapered spacers 119, and or between a tapered spacer 119 and one of first sidewall 113 and second sidewall 115. In such instances, reinforcement 121 may have a length corresponding to the spacing between two sequential tapered spacers 119, or a tapered spacer 119 and one of first sidewall 113 or second sidewall 115. In that regard, the spacing between sequential tapered spacers 119 and/or between a tapered spacer 119 and first sidewall 113 or second sidewall 115 is not limited, and any suitable spacing may be used. In embodiments, the spacing between sequential tapered spacers 119 and/or between a tapered spacer 119 and first sidewall 113 or second sidewall 115 ranges from greater than 0 to about 16 inches, such as from greater than 0 to about 12 inches, from greater than 0 to about 10 inches, from greater than 0 to about 8 inches, from greater than 0 to about 6 inches, from greater than 0 to about 4 inches, or even from greater than 0 to about 2 inches. Of course, larger or smaller spacing between such elements may also be used. In embodiments, the spacing between sequential tapered spacers 119 and/or between a tapered spacer 119 and first sidewall 113 or second sidewall 115 is about 4 to about 8 inches.

As further shown in various FIGS., roofing panel 100 may further include one or a plurality of short spacers 123. As best shown in FIGS. 1B, 1C, and IS, each short spacer 123 extends from bottom side 103 and has a short spacer proximal end 168 and a short spacer distal end 170. In the illustrated embodiment, the short spacer proximal end 168 is even or substantially even with front edge 105 and short spacer distal end 170 is disposed between front edge 105 and rear edge 107. Like standoffs 117, in the illustrated embodiment short spacers 123 each have a short spacer height that is the same or substantially the same as the first sidewall height and the second sidewall height at a corresponding portion of the first sidewall 113 and second sidewall 115. That is, the height measured at any point between a lower surface of short spacer 123 and a point of intersection between short spacer 123 and bottom side 103 may be the same or substantially the same as the first sidewall height or second sidewall height measured at a corresponding point on first sidewall 113 and second sidewall 115.

In the illustrated embodiment short spacers 123 have a thickness and two sides, wherein the two sides have a trapezoidal shape. Such a configuration is not required, however, and short spacers 123 may have any suitable geometric or irregular shape. For example, the sides of short spacers may have triangular, quadrilateral (square, rectangular, trapezoidal, etc.), pentagonal, or other shape. Without limitation, the shape of the sides of short spacers 123 is the same or substantially the same as the shape of a corresponding point of first sidewall 113 and second sidewall 115. In embodiments and as best shown in FIG. 1S, at least a portion of short spacer distal end 170 is in contact with a reinforcement 121.

Among other things, short spacers 123 function to support bottom side 103 and to maintain a gap G2 between bottom side 103 and material underlying roofing panel 100 (e.g., shingles, a biocidal source, etc.). More specifically, when roofing panel 100 is installed, a lower side of short spacers 123 may contact material under roofing panel 100, and limit or prevent bottom side 103 from sagging, bowing, or the like. While the illustrated embodiments depict short spacers 123 with a short spacer proximal end 168 that is even with front edge 105, such a configuration is not required. In embodiments short spacer proximal end 168 extends past front edge 105, e.g., by an offset distance O1 and/or O2 as discussed above. In such embodiments, a roofing retention element 141 may be integral with or coupled to part of short spacer 123 that extends past front edge 105.

The roofing panels described herein may include features that allow it to couple or otherwise connect with additional roofing panels, so as to increase the area of a biocidal source and/or roof that may be covered. For example, one side of roofing panel 100 may include one or more female coupling elements and the other side of roofing panel may include one or more male coupling elements. In such instances, the female coupling element(s) of a first roofing panel may couple with male coupling elements of a second roofing panel. Likewise, the male coupling element(s) of the first panel may couple with the female coupling element(s) of a third roofing panel. The female and male coupling elements may be configured such that when a first panel is coupled to a second panel, the top side 101 of the first panel is coplanar or substantially coplanar with the top side of the second panel.

With the foregoing in mind, FIGS. 1A-1Z depict an embodiment in which roofing panel 100 includes first and second female coupling elements 125, 129, and first and second male coupling elements 131, 133. As best shown in FIG. 1U, first and second female coupling elements 125, 129 are disposed on or within the first sidewall 113 of roofing panel 100. In the illustrated embodiments, first female coupling element 125 is in the form of a receptacle formed at an intersection between top side 101 and first sidewall 113. The receptacle includes an opening 127, which is sized and configured to receive a corresponding male coupling element, such as first male coupling element 131 of another roofing panel. Second female coupling element 129 is in the form of one or more slots formed in first sidewall 113, wherein the slots extend through the thickness of first sidewall 113, and extend from lower side 163 towards an upper part of first sidewall 113. In the illustrated embodiment, the slots of the second female coupling element 129 are each sized and configured to receive part of a second male coupling element, e.g., a corresponding interface member of another roofing panel.

As best shown in FIG. 1Z first and second male coupling elements 131, 133 are coupled to or integrally formed with second sidewall 115 of roofing panel 100. In the illustrated embodiments, first male coupling element 131 is in the form of a protuberance that extends from second sidewall 115 at a point proximate right edge 111. The protuberance is sized and configured such that it is receivable in a female coupling element, e.g., an opening 127 in a female coupling element of another roofing panel. Second male coupling element 133 is configured to be received within a second female coupling element of another roofing panel, such as one or more slots of a second female coupling element 129. In the illustrated embodiment, second male coupling element 133 includes a plurality of interface members 137 that extend from second sidewall 115 or optional indentations 147 in second sidewall 115. The second male coupling element 133 further includes a cross member 135 that extends between and couples the plurality of interface members 137. An opening 139 is present between two sequential interface members and between cross member 135 and second sidewall 115.

In operation, first and second roofing panels configured in the manner shown in FIGS. 1A-1Z may be coupled together by inserting the protuberance of first male coupling element 131 into the opening 127 of first female coupling element 125 and by disposing interface members 137 through the slots of second female coupling element 129, such that part of sidewall 113 is disposed through the openings 139 and cross member 135 is proximate an inward acing side of first sidewall 113.

Of course, the roofing panels described are not limited to using coupling elements that are configured in the manner shown in FIGS. 1A-1Z. Indeed, the present disclosure encompasses embodiments in which the roofing panels described herein can be coupled to another roofing panel in any suitable manner. For example, roofing panels described herein may be configured to couple to another roofing panel via one or more mechanical fasteners, an adhesive, a tape, mechanical interference fit joint, a snap fit joint, combinations thereof, and the like.

The roofing panels described herein may be coupled to a surface such as a roof in any suitable manner, such as via an adhesive, a mechanical fastener (e.g., nails, screws, etc.), combinations thereof, and the like. In that regard, FIGS. 1A-1Z depict an embodiment of a roofing panel that includes first fastener openings 143 and second fastener openings 145. The first and second fastener openings are generally configured to receive a mechanical or chemical fastener therein and to facilitate retention of roofing panel 100 to a surface (e.g., roof) and/or to roofing material (e.g., a shingle) by such fastener(s). The first and second fastener openings 143, 145 may be the same or different, and in some embodiments are different from one another.

In embodiments, first fastener opening 143 is smaller than second fastener opening 145. In such instances first fastener opening 143 may be provided to provide enhanced contact between an adhesive used to adhere roofing material (e.g., a shingle) to top side 101 of roofing panel 100. The top side 101 may further include optional grooves 149, which may also function to provide enhanced contact with an adhesive used to adhere roofing material to top side 101. In contrast, second fastener opening 145 may be configured to receive a mechanical fastener there through, wherein the mechanical fastener is to couple the roofing panel 100 to an underlying surface, such as a roof.

In embodiments, a gasket or other seal (not shown) is provided around or within first and second fastener openings, and functions to limit or prevent leakage of water there through. In embodiments, the gasket or seal is in the form of a rubber gasket (e.g., a solid disc or O-ring formed of butyl rubber or other suitable elastomeric material)

Roofing panel 100 is preferably sufficiently flexible as to allow it to be rolled upon itself, e.g., from first sidewall 113 to second sidewall 115 or vice versa. In that regard, all or a portion of the body member may be formed from one or more flexible polymeric materials, such as but not limited to elastomeric polymers, rubbers, combinations thereof, and the like. Non-limiting examples of such materials include flexible polymers, e.g., polyolefins such as polyethylene (e.g., high density polyethylene), polypropylene, combinations thereof and the like. Without limitation, in embodiments roofing panel 100 is configured such that it can be rolled upon itself with a coil length that is less than one half (preferably less than one quarter or even one eighth) of the distance between first sidewall 113 to second sidewall 115. In those or other embodiments, roofing panel 100 is configured to be rollable even when coupled to additional roofing panels, e.g., via the male and female coupling elements discussed above. Thus, for example, a plurality of roofing panels 100 may be coupled to one another via coupling elements to form an elongated chain of roofing panels that can be rolled into a single continuous roll.

Figure 2A:
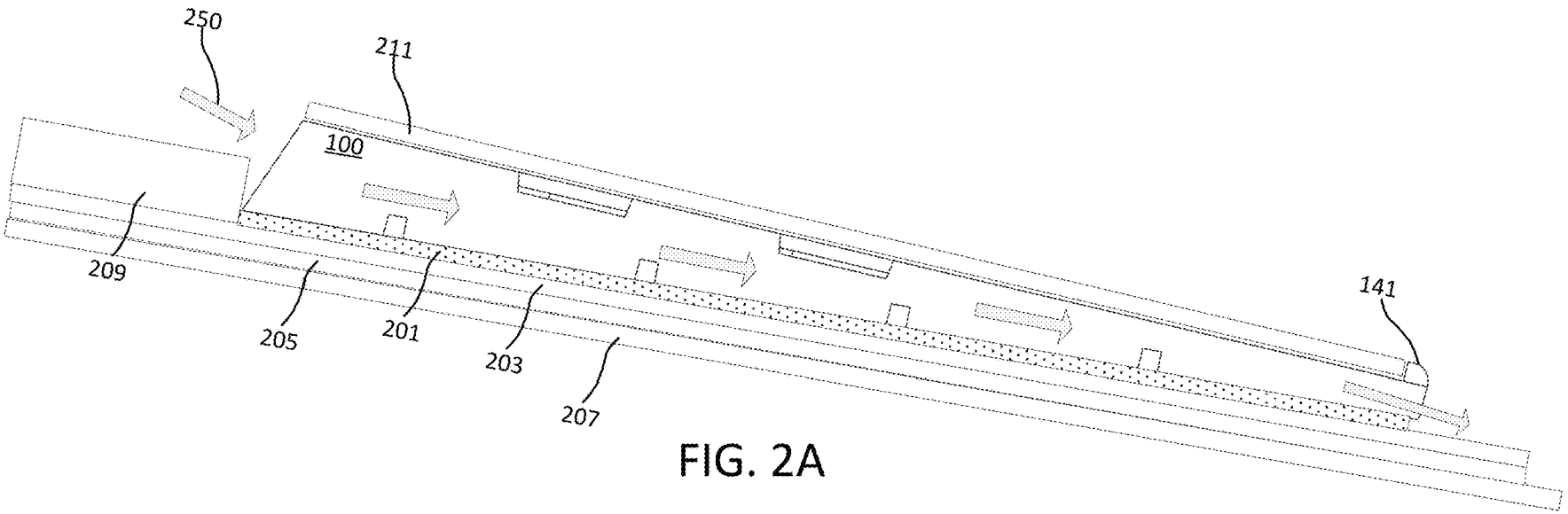
FIG. 2A is a schematic view of one example of a roofing panel consistent with the present disclosure installed on a roof.
Figure 2B:
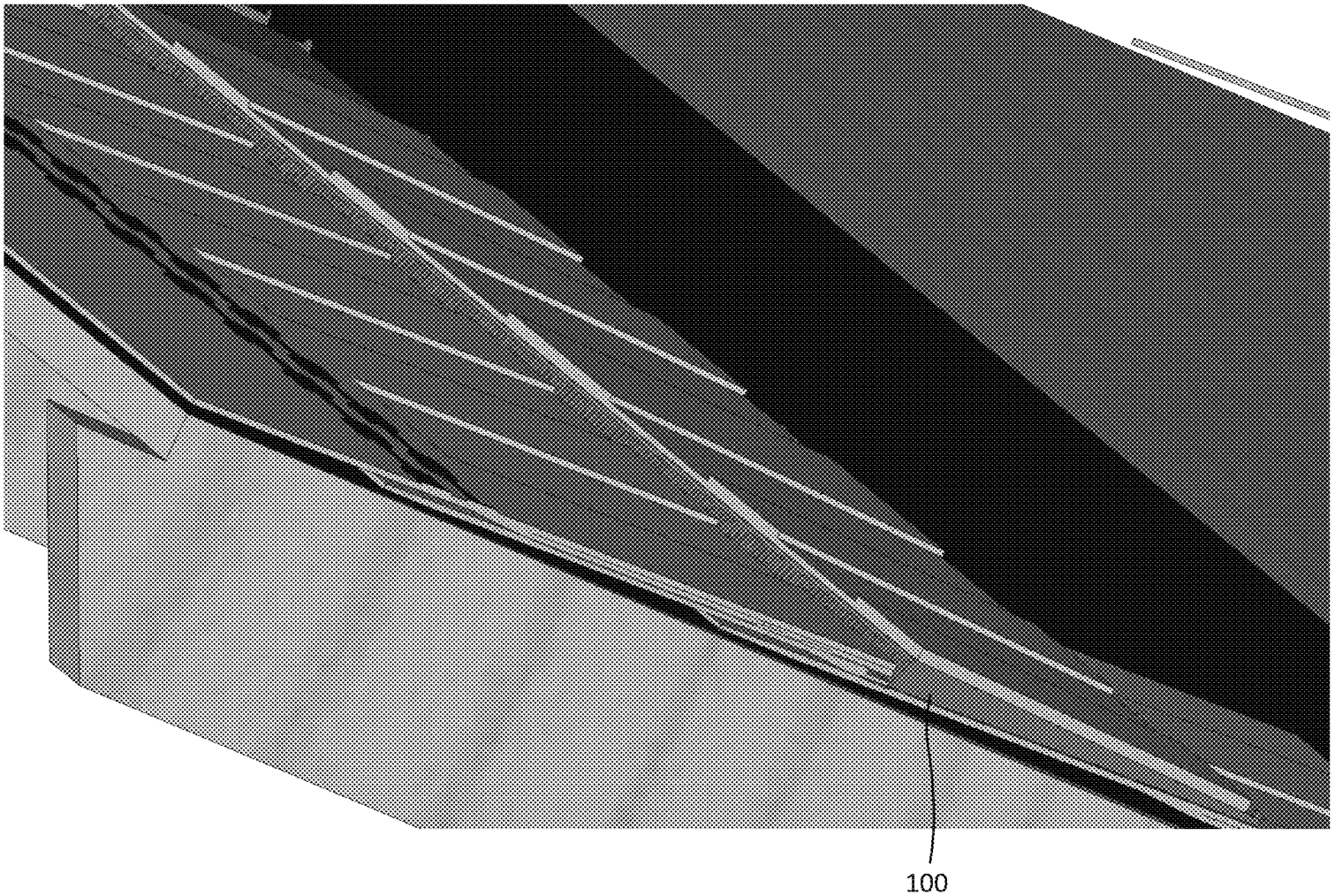
FIG. 2B is a computer generated cross sectional view of a roofing panel consistent with the present disclosure installed on a roof.
Figure 2C:
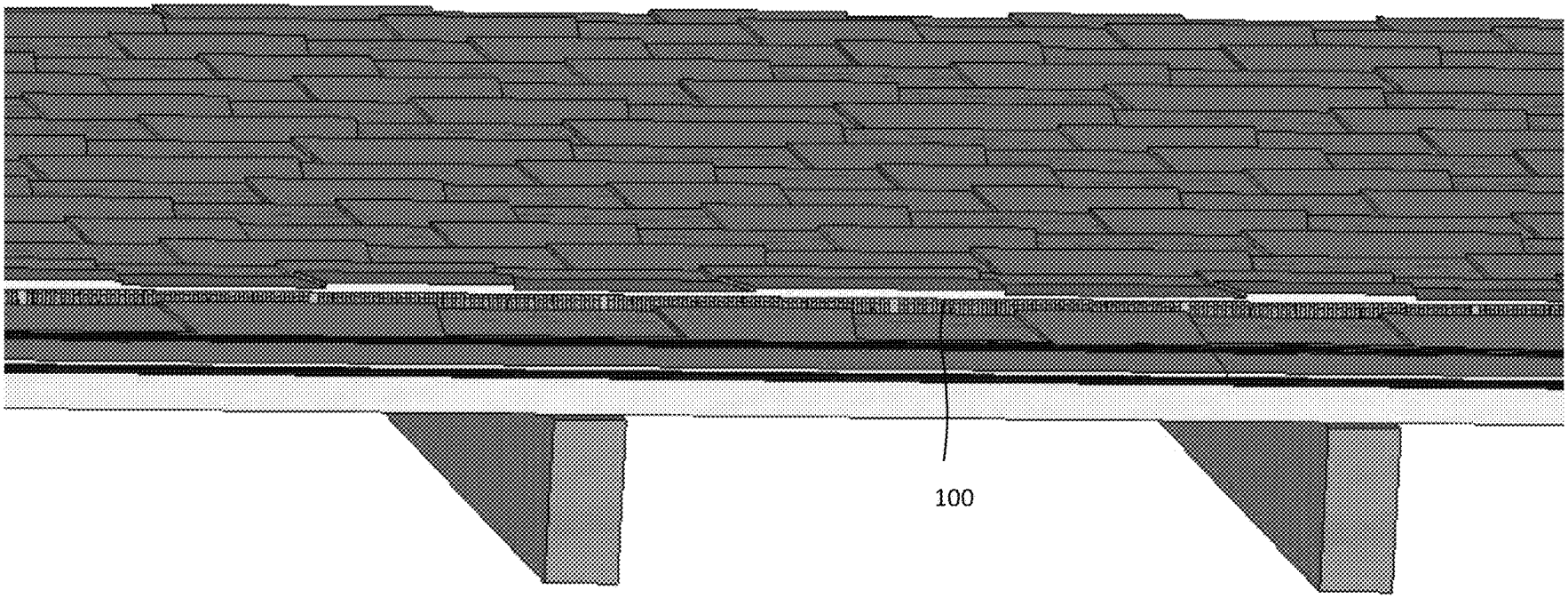
FIG. 2C is a computer generated downhill perspective view of a roofing panel consistent with the present disclosure installed on a roof.

FIGS. 2A-2C depict an example installation of a roofing panel consistent with the present disclosure on a roof with a biocidal source. As best shown in FIG. 2A, a biocidal source 201 such as an elongated strip of metal (e.g., copper, zinc, lead or the like) may be installed on a first shingle 203, which in turn is installed on underlayment 205 (e.g., felt paper) that is disposed on roof 207 (e.g., sheathing). The body of an upstream shingle 209 is also installed on first shingle 203. A roofing panel 100 is installed over the biocidal source 201 and below the lower end of the body of upstream shingle 209, e.g., with one or more mechanical fasteners driven through second fastener openings 145. Before or after the installation of roofing panel 100, a profile portion 211 may be separated from upstream shingle 209 or another shingle. The profile portion 211 may be adhered to the top side 101 of roofing panel 100 via an adhesive, a mechanical fastener, or both. To facilitate retention of the profile portion 211 on top side 101 (particularly when an adhesive is used), the lower edge of profile portion 211 may be supported by the abutment surface of roofing retention elements 141, as shown. First and second sidewalls 113, 115 and standoffs 117 provide a gap between upstream shingle 209 and roofing panel 100. In operation, water 250 flowing down the roof will flow through channels between standoffs 117 and onto the exposed surface of biocidal source 201 that is covered by the body of roofing panel 100. The water 250 will continue to flow downhill and through the gap provided by first and second sidewalls 113, 115 and tapered spacer elements between biocidal source 201 and the bottom side 103 of roofing panel 100. Biocidal material incorporated into the water 250 will then be distributed over the other parts of the roof 207 as the water flows downstream of the roofing panel 100.

EXAMPLES

Example 1: According to this example there is provided a roofing panel, including: a body having a top side, a bottom side parallel with the top side, a front edge, a rear edge, a right edge, and a left edge; a first sidewall extending from the bottom side, the first sidewall including a first sidewall distal end proximate the rear edge and a first sidewall proximal end proximate the front edge; a second sidewall extending from the bottom side, the second sidewall including a second sidewall distal end proximate the rear edge and a second sidewall proximal end proximate the front edge; wherein: the first and second sidewalls each have a sidewall height that tapers from a height HR proximate the rear edge and a height HF proximate the front edge; HF is less than HR; and HF is greater than 0.

Example 2: This example includes any or all of the features of example 1, wherein the sidewall height tapers linearly from HR to HF.

Example 3: This example includes any or all of the features of example 1, wherein the first and second sidewalls are each substantially perpendicular to the bottom side.

Example 4: This example includes any or all of the features of example 1, further including a plurality of standoffs, wherein: each of the plurality of standoffs extends from the bottom side; and the plurality of standoffs comprises at least a first standoff and a second standoff spaced laterally apart from the first standoff with a channel therebetween.

Example 5: This example includes any or all of the features of example 4, wherein each of the plurality of standoffs: comprises a standoff distal end proximate the rear edge and a standoff proximal end; and is oriented substantially parallel to the first sidewall and the second sidewall.

Example 6: This example includes any or all of the features of example 4, wherein: each of the plurality of standoffs has a first standoff side and a second standoff side; and the first and second standoff sides each have a trapezoidal shape and are oriented substantially parallel to the first sidewall and the second sidewall.

Example 7: This example includes any or all of the features of example 4, wherein each of the plurality of standoffs has a standoff height, wherein the standoff height tapers from HR to a height less than HR.

Example 8: This example includes any or all of the features of example 7, wherein the standoff height is substantially the same as the sidewall height at a corresponding point on the first and second sidewalls.

Example 9: This example includes any or all of the features of example 5, wherein the standoff proximal end is between the rear edge and the front edge.

Example 10: This example includes any or all of the features of example 5, further including at least one tapered spacer, wherein the at least one tapered spacer; extends from the bottom side of the body; and is located between the first sidewall and the second sidewall.

Example 11: This example includes any or all of the features of example 10, wherein: the at least one tapered spacer comprises a spacer distal end proximate the rear edge and a spacer proximal end; the at least one tapered spacer and is oriented substantially parallel to the first sidewall and the second sidewall; and the spacer proximal end is located proximate the front edge.

Example 12: This example includes any or all of the features of example 11, wherein: the first sidewall and second sidewall each extend past the front edge such that the first sidewall proximal end and second sidewall proximal end are each out of alignment with the front edge.

Example 13: This example includes any or all of the features of example 12, wherein the at least one tapered spacer extends past the front edge such that the spacer proximal end is out of alignment with the front edge.

Example 14: This example includes any or all of the features of example 13, wherein the standoff proximal end is between the rear edge and the front edge.

Example 15: This example includes any or all of the features of example 10, wherein the at least one tapered spacer has a spacer height, wherein the spacer height tapers from HR to HF and is substantially the same as the sidewall height at a corresponding point on the first and second sidewalls.

Example 16: This example includes any or all of the features of example 13, further including a plurality of roofing retention elements configured to maintain a position of roofing placed on the top side of the roofing panel.

Example 17: This example includes any or all of the features of example 13, further including: a first roofing retention element coupled to the first sidewall proximate the first sidewall proximal end; a second roofing retention element coupled to the second sidewall proximate the second sidewall proximal end; and a third roofing retention element coupled to the at least one tapered spacer proximate the spacer proximal end.

Example 18: This example includes any or all of the features of example 4, further including a plurality of reinforcements, wherein each of the plurality of reinforcements extends from the bottom side and between the first sidewall and the second sidewall.

Example 19: This example includes any or all of the features of example 18, wherein: each of the plurality of reinforcements is coupled to the first sidewall and the second sidewall; each of the plurality of reinforcements has a first reinforcement height measured at a point at which the reinforcement is coupled to the first sidewall and a second reinforcement height measured at a point at which the reinforcement is coupled to the second sidewall; the first reinforcement height is less than the sidewall height measured at the point at which the reinforcement is coupled to the first sidewall; and the second reinforcement height is less than the sidewall height measured at the point at which the reinforcement is coupled to the second sidewall.

Example 20: This example includes any or all of the features of 4, wherein: the first sidewall comprises a male coupling element for coupling the roofing panel to a female coupling element of another roofing panel; and the second sidewall comprises a female coupling element for coupling the roofing panel to a male coupling element of another roofing panel.

Example 21: This example includes any or all of the features of example 20, wherein the female coupling element comprises at least one receptacle formed at an interface between the first sidewall and the left edge.

Example 22: This example includes any or all of the features of example 21, wherein the female coupling element further comprises at least one slot formed in the first sidewall.

Example 23: This example includes any or all of the features of example 20, wherein the male coupling element comprises: a protuberance extending from the second sidewall proximate an interface between the right edge and the second sidewall.

Example 24: This example includes any or all of the features of example 23, wherein: the male coupling element further comprises: a first interface member extending from the second sidewall; a second interface member extending from the second sidewall; and a cross member extending between and coupled to the first interface member and the second interface member; and a gap is present between the first and second interface member and the second sidewall and the cross member.

Example 25: This example includes any or all of the features of example 1, further including at least one fastener opening extending through the body.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A roofing panel, comprising:

a body having a top side, a bottom side opposite the top side, a front edge, a rear edge, a right edge, and a left edge;

a first sidewall extending from the bottom side, the first sidewall comprising a first sidewall distal end proximate said rear edge and a first sidewall proximal end proximate said front edge;

a second sidewall extending from the bottom side, the second sidewall comprising a second sidewall distal end proximate said rear edge and a second sidewall proximal end proximate said front edge;

a plurality of standoffs; and a plurality of reinforcements;

wherein:

the first sidewall has a first sidewall height and the second sidewall has a second sidewall height, the first and second sidewall heights each tapering from a height HR proximate the rear edge and a height HF proximate the front edge;

HF is less than HR;

HF is greater than 0;

each of the plurality of standoffs extends from the bottom side;

the plurality of standoffs comprises at least a first standoff and a second standoff spaced laterally apart from the first standoff with a channel therebetween;

each of said plurality of reinforcements extends from said bottom side and between said first sidewall and said second sidewall, and is coupled to the first sidewall and the second sidewall;

each of the plurality of reinforcements has a first reinforcement height measured at a point at which the reinforcement is coupled to the first sidewall and a second reinforcement height measured at a point at which the reinforcement is coupled to the second sidewall;

the first reinforcement height is less than the first sidewall height measured at the point at which the reinforcement is coupled to the first sidewall; and the second reinforcement height is less than the second sidewall height measured at the point at which the reinforcement is coupled to the second sidewall.

2. A roofing panel, comprising:

a body having a top side, a bottom side opposite the top side, a front edge, a rear edge, a right edge, and a left edge;

a first sidewall extending from the bottom side, the first sidewall comprising a first sidewall distal end proximate said rear edge and a first sidewall proximal end proximate said front edge;

a second sidewall extending from the bottom side, the second sidewall comprising a second sidewall distal end proximate said rear edge and a second sidewall proximal end proximate said front edge;

a first standoff extending from the bottom side and a second standoff extending from the bottom side, the first and second standoffs oriented substantially parallel to the first sidewall and the second sidewall;

at least one tapered spacer that extends from the bottom side of said body, is located between the first sidewall and the second sidewall, and is oriented substantially parallel to the first sidewall and the second sidewall;

wherein:

the first sidewall has a first sidewall height and the second sidewall has a second sidewall height, the first and second sidewall heights each tapering from a height HR proximate the rear edge and a height HF proximate the front edge;

HF is less than HR;

HF is greater than 0;

HR and HF are selected such that when the roofing panel is installed on an underlying surface, a gap G1 is provided between the bottom side of the roofing panel at the rear edge and the underlying surface, and a gap G2 is provided between the bottom side of the roofing panel at the front edge and the underlying surface, the gaps G1 and G2 configured such that water can flow into the gap G1, under the roofing panel, and out of the gap G2;

the first and second standoffs are spaced laterally apart from one another with a channel therebetween;

the first and second standoffs each comprise a standoff distal end proximate the rear edge and a standoff proximal end;

the at least one tapered spacer comprises a spacer distal end proximate said rear edge and a spacer proximal end located proximate the front edge;

the first and second sidewall each extend past the front edge such that the first sidewall proximal end and second sidewall proximal end are each out of alignment with the front edge; and the at least one tapered spacer extends past said front edge such that the spacer proximal end is out of alignment with the front edge.

3. The roofing panel of claim 2, wherein the first sidewall and the second sidewall height each taper linearly from HR to HF.

4. The roofing panel of claim 2, wherein the first and second sidewalls are each substantially perpendicular to said bottom side.

5. The roofing panel of claim 2, wherein:

each of the plurality of standoffs has a first standoff side and a second standoff side; and the first and second standoff sides each have a trapezoidal shape and are oriented substantially parallel to the first sidewall and the second sidewall.

6. The roofing panel of claim 2, wherein each of the plurality of standoffs has a standoff height, wherein said standoff height tapers from HR to a height less than HR.

7. The roofing panel of claim 6, wherein the standoff height is substantially the same as the first sidewall height and the second sidewall height at corresponding points on said first and second sidewalls.

8. The roofing panel of claim 2, wherein the standoff proximal end is between the rear edge and the front edge.

9. The roofing panel of claim 2, wherein the standoff proximal end is between the rear edge and the front edge.

10. The roofing panel of claim 2, wherein the at least one tapered spacer has a spacer height, wherein the spacer height tapers from HR to HF and is substantially the same as the first sidewall height and the second sidewall height at corresponding points on said first and second sidewalls.

11. The roofing panel of claim 2, further comprising a plurality of roofing retention elements configured to maintain a position of roofing placed on said top side of said roofing panel.

12. The roofing panel of claim 2, further comprising:

a first roofing retention element coupled to said first sidewall proximate said first sidewall proximal end;

a second roofing retention element coupled to said second sidewall proximate said second sidewall proximal end; and a third roofing retention element coupled to said at least one tapered spacer proximate said spacer proximal end.

13. The roofing panel of claim 2, further comprising a plurality of reinforcements, wherein each of the plurality of reinforcements extends from said bottom side and between said first sidewall and said second sidewall.

14. The roofing panel of claim 2, wherein:

the first sidewall comprises a male coupling element for coupling the roofing panel to a female coupling element of another roofing panel; and the second sidewall comprises a female coupling element for coupling the roofing panel to a male coupling element of another roofing panel.

15. The roofing panel of claim 14, wherein the female coupling element comprises at least one receptacle formed at an interface between the first sidewall and the left edge.

16. The roofing panel of claim 15, wherein the female coupling element further comprises at least one slot formed in said first sidewall.

17. The roofing panel of claim 14, wherein the male coupling element comprises:

a protuberance extending from said second sidewall proximate an interface between said right edge and said second sidewall.

18. The roofing panel of claim 17, wherein:

the male coupling element further comprises:

a first interface member extending from said second sidewall;

a second interface member extending from said second sidewall; and a cross member extending between and coupled to the first interface member and the second interface member; and a gap is present between the first and second interface member and the second sidewall and the cross member.

19. The roofing panel of claim 2, further comprising at least one fastener opening extending through the body.

* * * * *